United States Patent [19]

Kirsch

[11] 4,113,276

[45] Sep. 12, 1978

[54] SKI BINDING AUTOMATICALLY RELEASABLE BY OVERSTRESS

[76] Inventor: Bernhard Kirsch, Im Litzelholz 23, 5500 Trier-Biewer, Fed. Rep. of Germany

[21] Appl. No.: 756,469

[22] Filed: Jan. 3, 1977

[30] Foreign Application Priority Data

Dec. 31, 1975 [DE] Fed. Rep. of Germany ..... 2559271
Feb. 6, 1976 [DE] Fed. Rep. of Germany ..... 2604513
Apr. 10, 1976 [DE] Fed. Rep. of Germany ..... 2615806

[51] Int. Cl.[2] ..... A63C 9/08

[52] U.S. Cl. ..... 280/616; 280/618; 280/625

[58] Field of Search ..... 280/625, 624, 635, 618, 280/617, 616, 626, 611

[56] References Cited

U.S. PATENT DOCUMENTS

| | | | |
|---|---|---|---|
| 2,517,795 | 8/1950 | Majneri | 280/635 |
| 3,079,163 | 2/1963 | De Beausacq | 280/616 |
| 3,740,064 | 6/1973 | Weg | 280/624 |
| 3,963,253 | 6/1976 | Rieger | 280/617 X |
| 3,985,370 | 10/1976 | Giorgetti et al. | 280/626 X |

FOREIGN PATENT DOCUMENTS

| | | | |
|---|---|---|---|
| 245,998 | 3/1966 | Austria | 280/618 |
| 571,210 | 12/1957 | Italy | 280/635 |

*Primary Examiner*—Joseph F. Peters, Jr.
*Assistant Examiner*—Milton L. Smith
*Attorney, Agent, or Firm*—Robert W. Beach; Ward Brown

[57] ABSTRACT

Two sole clips are mounted on rods received in guide sleeves extending longitudinally of a ski, which guide sleeves are pivoted for swinging relative to the ski. A spring resists swinging of the sleeves relative to the ski, and another spring resists forward reciprocation of the rods in the guide sleeves. Under overstress conditions between a ski boot and the ski, the forward force on the sole clips will slide the rods forward in the guide sleeves and swivel one of the sole clips relative to its guide sleeve to release such clip from the boot sole for automatically freeing the boot from the ski.

31 Claims, 67 Drawing Figures

Fig.56
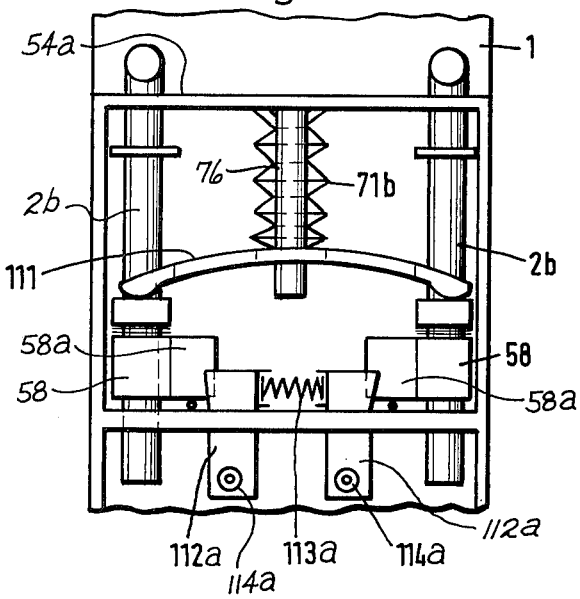
Fig.58
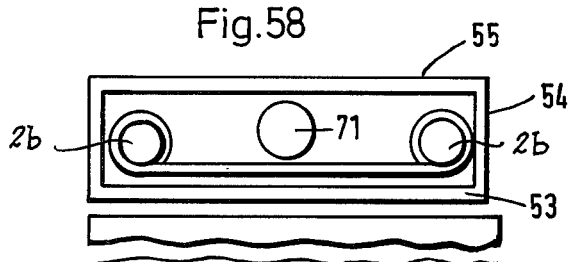
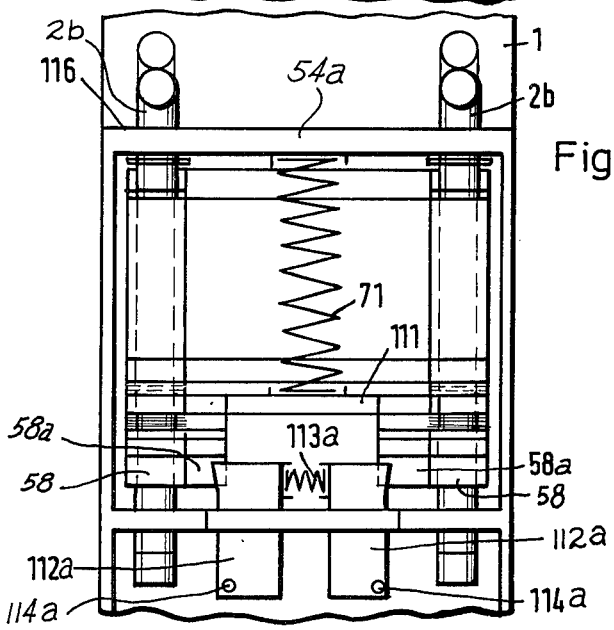
Fig.57

Fig. 59
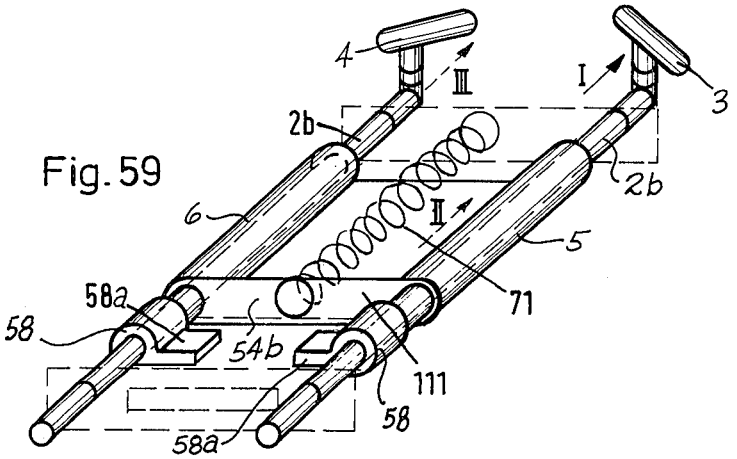
Fig. 60
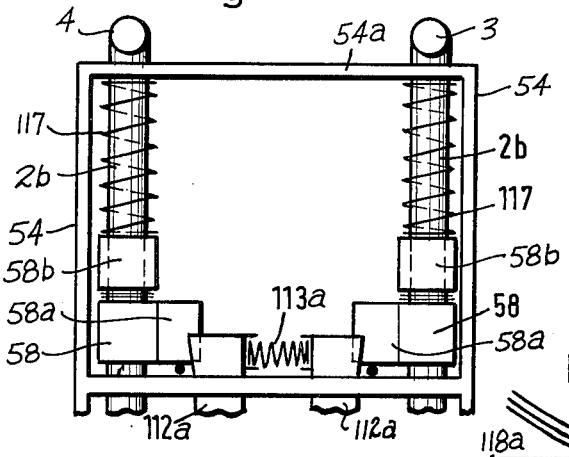
Fig. 61
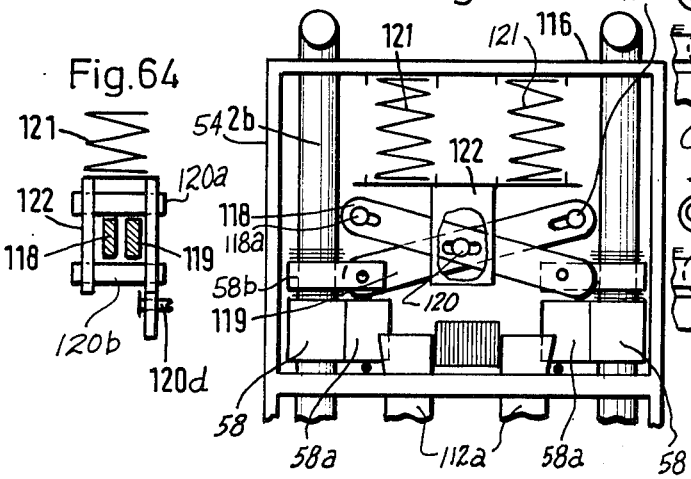
Fig. 62
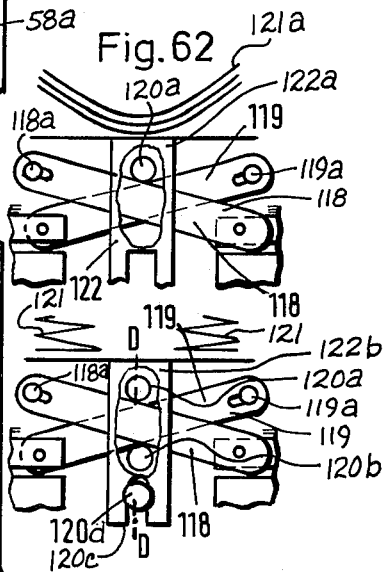
Fig. 63
Fig. 64

SKI BINDING AUTOMATICALLY RELEASABLE BY OVERSTRESS

BACKGROUND OF THE INVENTION

1. Field of the Invention

This invention relates to ski bindings and particularly to ski bindings which will be released automatically by overstress of a ski boot relative to the ski.

2. Prior Art

Ski bindings having sole clips which can swivel outwardly about a longitudinal axis to release a ski boot are known, and such sole clips have been releasable automatically upon overstress between the ski boot and the ski in a direction transversely of the ski. Such prior ski bindings have not been constructed to release automatically, however, when the overstress between the ski boot and the ski has occurred in a direction longitudinally of the ski. If the tip of the ski should strike an object, therefore, and stop or drastically retard forward movement of the ski so that the ski boot exerts an overstress toward the front of the ski because of the inertia of the skier, the previously known types of ski bindings will not be released. Consequently, the skier will tend to execute a somersault which can cause very serious injury.

SUMMARY OF THE INVENTION

It is the principal object of this invention to construct a ski binding which will automatically release a ski boot from a ski in the event that the tip of the ski strikes an obstruction so that it is stopped, or its continued movement is drastically retarded, resulting in the ski boot exerting an overstress on the ski binding in a forward direction.

A further object of the invention is to provide a ski binding which will automatically release a ski boot from a ski upon the occurrence of predetermined overstress but which normally will hold the boot firmly relative to the ski.

A more specific object is to provide spring force to maintain sole clips for a ski boot in a condition for effectively holding the ski boot on the ski. Such spring force preferably is a combination of a rearward force, a lateral centering force, and a force tending to hold the sole clips in engagement with the boot sole.

It is also an object to enable one or more of the spring forces tending to hold the ski boot on the ski to be adjusted for varying the degree of spring force exerted.

Another object is to provide positive trip mechanism for moving a sole clip into released position when the sole clip has been displaced a predetermined amount relative to the ski.

The foregoing objects can be accomplished by providing a ski binding having sole clips carried by respective rods extending lengthwise of the ski which are rotatively and longitudinally slidably mounted in guide sleeves for swiveling outward about the longitudinal axes of the rods and guide sleeves to release a ski boot sole.

BRIEF DESCRIPTION OF THE DRAWINGS

FIG. 56 is a plan of a further modified type of ski binding similar to that of FIG. 55.

FIG. 57 is a plan of a ski binding similar to that shown in FIG. 56 with a modified component, parts being shown in section.

FIG. 58 is a vertical transverse section through a ski showing the ski binding of FIG. 57 in end elevtion.

FIG. 59 is a somewhat diagramatic top perspective view of the form of ski binding shown in FIGS. 57 and 58.

FIG. 60 is a plan of a ski binding generally like that of FIG. 56 with still another modification.

FIG. 61 is a plan of a ski binding generally like that of FIG. 56 with a further modified form of the same component.

FIGS. 62 and 63 are fragmentary plans of alternative types of components of the ski binding shown in FIG. 61.

FIG. 64 is a fragmentary vertical longitudinal section through the ski binding of FIG. 63 taken along line D—D of that figure.

A characteristic of all of the forms of the ski binding is that each sole clip is mounted on a rod that is received in a guide, such as a guide sleevve, for both swiveling and longitudinal movement relative to the guide, accomplished by application to a sole clip by the ski boot of a force considerably exceeding a predetermined normal force. Moreover, in most forms of the invention, the guide is mounted to swing transversely of the ski about a pivot having an axis extending substantially perpendicular to the ski. The guide sleeves for the two swivels may swing about their pivots independently, or the guide sleeves may be constructed for conjoint swinging movement.

Figure 1:
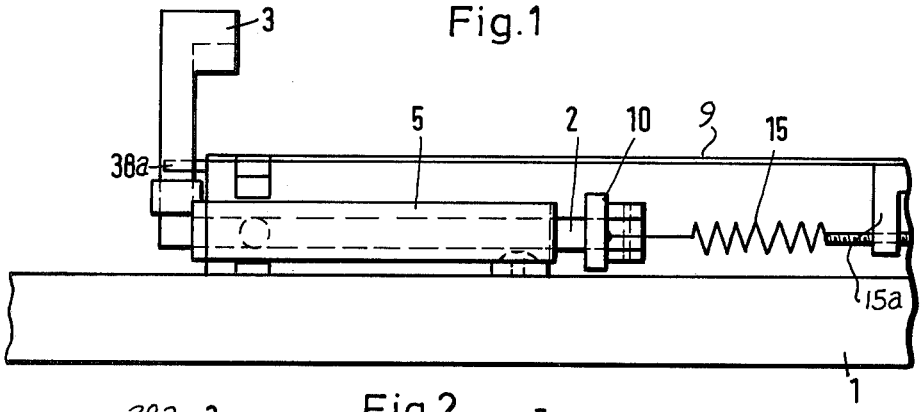
FIG. 1 is a vertical longitudinal section through a ski binding according to the present invention.

The ski binding shown in FIGS. 1 to 4 as being mounted on the upper surface of a ski 1 includes two swivel rods 2 extending generally longitudinally of the ski and spaced apart transversely of the ski. A sole clip 3 in the form of a hook is carried by the forward end of the right swivel rod 2 and normally projects upward from it as shown in FIG. 1. A second sole clip 4 in the form of a hook is carried by the forward end of the left swivel rod 2 and normaly projects upward from it in the same manner as the sole clip 3 is shown. The right rod 2 extends through the bore of a guide sleeve 5 by which the rod 2 is guided for swiveling and lengthwise movement relative to the sleeve. The left rod 2 extends through the ore of a guide sleeve 6 by which the rod is guided for swiveling and lengthwise movement relative to the sleeve.

The right sleeve 5 is mounted on the ski 1 by a pivot 7 projecting through a lug extending laterally outward from the rearward end of the sleeve which guides the sleeve for swinging relative to the ski through a small angle between stop pins 39 upstanding from the ski. The guide sleeve 6 is mounted on the ski 1 by a pivot 8 extending through a lug projecting laterally outwardly from the rearward end of the sleeve which guides the sleeve for swinging relative to the ski 1 through a limited angle between stop pins 39 projecting upward from the ski.

The rearward ends of the swivel rods 2 are interconnected by a crossbar 10 having slots 11 and 12 in its opposite end portions that receive, respectively, reduced portions of the rearward ends of the rods 2. The reduced portion of the right rod is retained in slot 11 by a ball-shaped head 13 and the reduced portion of the left swivel rod 2 is retained in slot 12 by a ball-shaped head 14. The slots 11 and 12 are of a length sufficient to enable the guide sleeves 5 and 6 to swing between their positions of closest approach shown in FIG. 2, and outwardly swung positions to enable the sole clips 3 and 4 to fit ski boots of widely different size.

Figure 4:
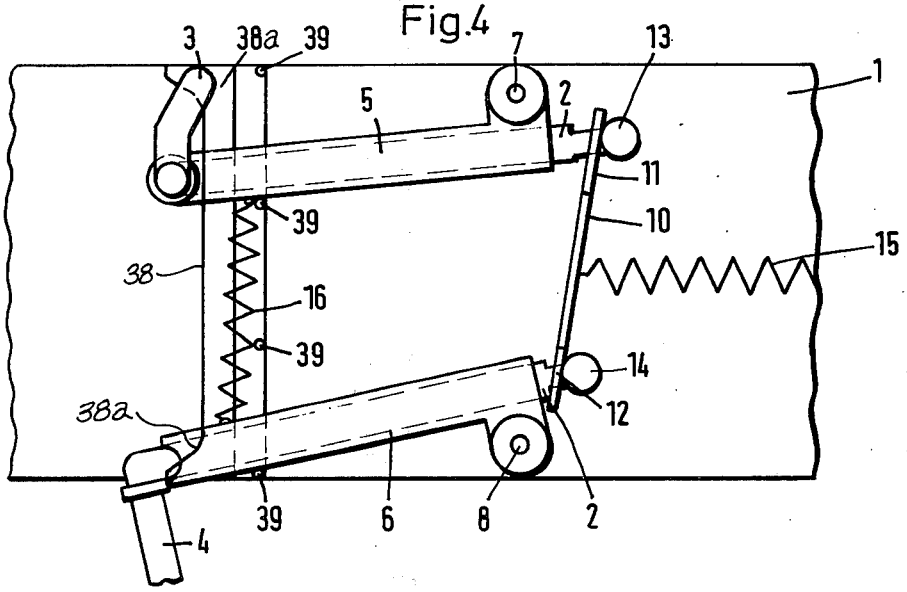
FIG. 4 is a plan corresponding to FIG. 2 showing parts in different positions and having parts broken away.

Also the crossbar 10 and the extent of slots 11 and 12 lengthwise of it are sufficient to enable one of the guide sleeves to swing outward relative to the other sleeve while at the same time the swivel rod 2 in such outwardly swinging sleeve slides forward relative to such sleeve as illustrated with respect to the left rod 2 and sleeve 6 in FIG. 4. The swivel rods 2 are normally held in their rearward positions shown in FIG. 2 by a yieldable force applied to the crossbar 11. Such yieldable force is provided to the ski binding shown in FIGS. 1 to 4 by the helical tension spring 15 connected between the center of the crossbar 11 and an anchor 15*a* which is adjustable lengthwise of the ski to alter the rearward pull exerted on the crossbar by the spring.

The swingable guide sleeves 5 and 6 are urged toward each other by the force exerted on them by a helical tension spring 16 interconnecting such sleeves. The force of such spring will pull the sleeves into their condition of closest approch shown in FIG. 2 against inner stops 39 when there is no ski boot sole engaged by the clips 3 and 4. When a ski boot is engaged with the ski binding, the sole of the boot will force the toe clips 3 and 4 apart to a greater or lesser extent depending upon the size of the boot and the spring 16 will hold the toe clips in engagement with the boot sole to retain the boot reliably on the foot plate 9 of the ski during normal use of the ski.

Figure 2:
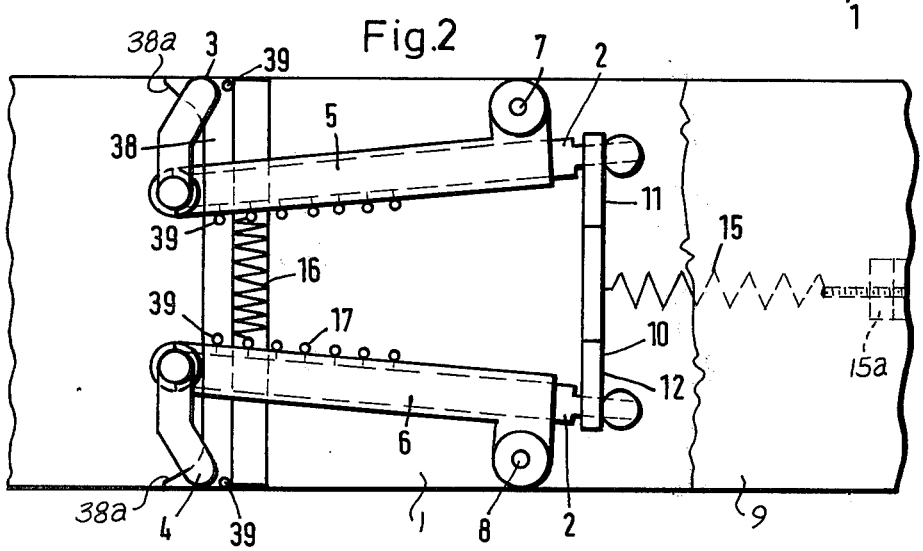
FIG. 2 is a plan of such binding.
Figure 3:
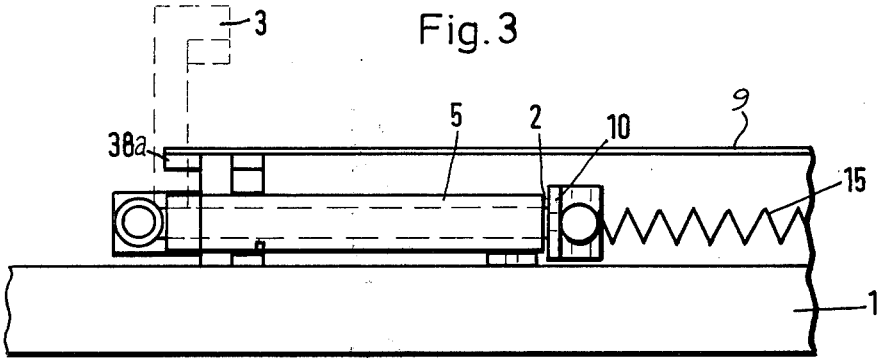
FIG. 3 is a longitudinal section corresponding to FIG. 1 showing parts in different positions.

The force by which the toe clips 3 and 4 engage the ski boot sole can be selected as desired depending on the size of the boot by selecting a tension spring 16 of the desired strength. Otherwise, the force can be varied by anchoring the opposite ends of the spring 16 to the sleeves 5 and 6 at different distances from the pivots 7 and 8. For this purpose, rows of spaced eyelets 17 can be arranged along the quide sleeves as shown in FIG. 2 for engagement by hooks on the ends of spring 16. The farther such spring is located from the pivots 7 and 8, the greater will be the inward force exerted by the toe clips 3 and 4 on the ski boot sole.

During normal use of the ski, the ski boot can turn to a limited extent relative to the ski without the ski binding releasing the boot. The degree of boot turning is limited by a fixed crosspiece 38 having a forward edge extending transversely of the ski immediately rearwardly of the rear-most positions of the shanks of the toe clips 3 and 4. The rearmost positions of such shanks can be established either by engagement of such shanks with the forward ends of the guide sleeves 5 and 6 or by engagement of such shanks with the forward edge of crosspiece 38.

The important feature of such crosspiece 38 is that the edges of its opposite end portions are inclined forwardly and outwardly so that when a shank of a toe clip is engaged with such inclined edge by excessive lateral pressure, the rod 2 carrying such toe clip will be wedged forward in opposition to the rearwardly-acting force of spring 15 until the shank of the swivel toe clip escapes beyond the forward end of the incline 38*a*. During engagement of the shank of the toe clip with the inclined surface 38*a*, such surface, being above the swivel axis defined by the axis of rod 2, will hold the toe clip against outward swiveling. As soon as the shank of the toe clip escapes beyond the forward end of the inclined edge 38*a*, however, the restraint of such inclined edge will be eliminated and the outward force of the ski boot sole on the toe clip will swing it downward into the released position of the toe clip 4 shown in the lower portion of FIG. 4 to free the ski boot sole.

If, instead of excessive force being exerted laterally by a ski boot on the ski binding, the excessive force is exerted forwardly, such as resulting from the inertia of a skier's body when a ski strikes an obstruction or great resistance to forward movement, such forwardly-acting excessive force will act directly on the toe clips 3 and 4 to slide the rods 2 forwardly in opposition to the force of the tension spring 15. Such forward sliding of the rods 2 will move the shanks of the toe clips away from the inclined ends 38*a* of the crosspiece 38 so that a slight lateral force of the ski boot sole against either of the clips 3 and 4 will cause that clip to swivel about the axis of its swivel rod 2 to release the ski boot.

Figure 5:
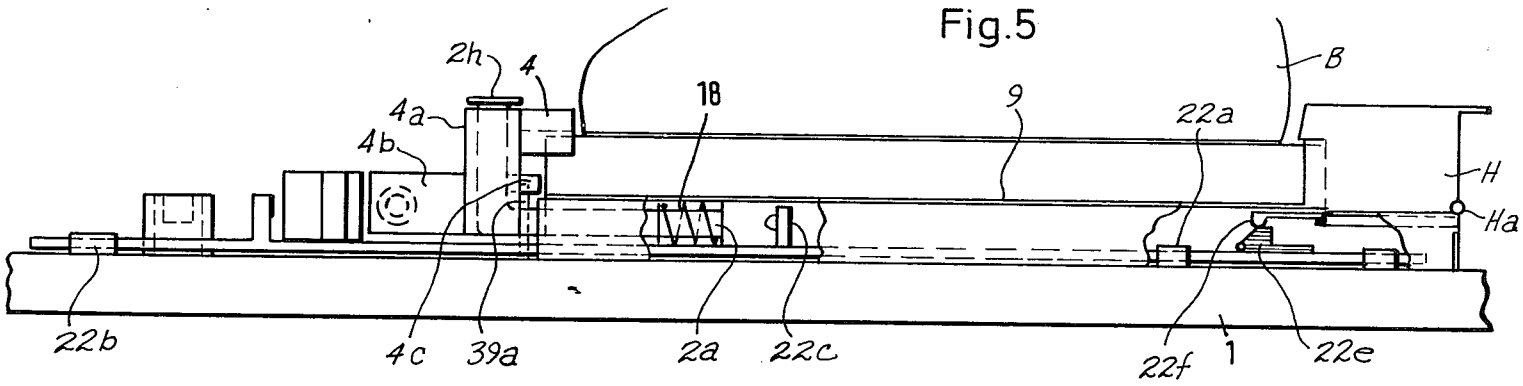
FIG. 5 is a side elevation of a different form of ski binding according to the present invention with parts broken away.
Figure 6:
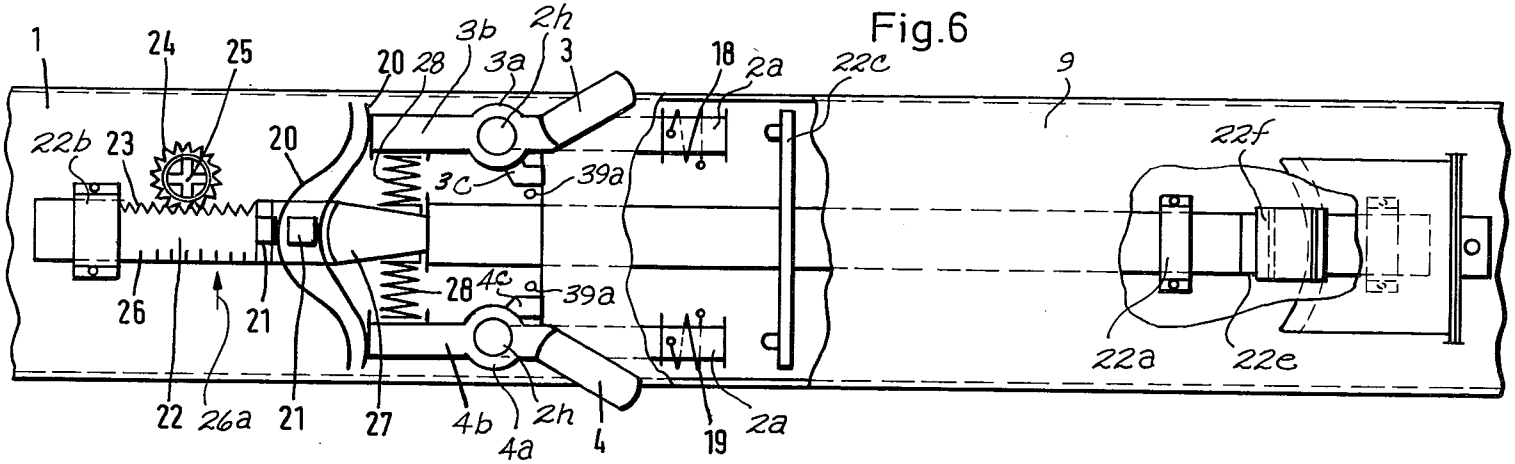
FIG. 6 is a plan of such ski binding with parts broken away.

In the ski binding shown in FIGS. 5 and 6, the toe clips 3 and 4 again are mounted on the forward ends of reciprocable swivel rods, but, in this instance, the rods include a portion 2*a* extending longitudinally of the ski and an upturned front end portion 2*b* over which a sleeve 3*a* or 4*a* of the toe clips 3 and 4, respectively, extends. Thus the toe clips have a double swiveling action, namely, an outwardly swiveling action about the longitudinal axes of the rod portions 2*a* extending longitudinally of the ski, and a second swiveling action about the axes, respectively, of the normally upright rod portions 2*b*.

In the ski binding of FIGS. 5 and 6, the swivel rods 2*a* again are received in guide sleeves, not shown, in which the longitudinal portions 2*a* of the rods can swivel and reciprocate. In this construction, the guide sleeves are fixed relative to the ski 1 instead of being mounted swingably. Consequently, the swiveling of the rods 2*a* in the guide sleeves cannot be controlled by inclined ends 38*a* of a crosspiece 38, as shown in FIGS. 1 to 4. Instead, a torsion spring 18 in connected between the fight swivel rod 2*a* and its guide sleeve and a torsion spring 19 is connected between the left swivel rod 2*a* and its guide sleeve. These torsion springs oppose outward swiveling of the toe clips 3 and 4 to release the ski boot unless the ski boot exerts a lateral outward force relative to the ski exceeding such force that would be produced during normal use of the ski.

As in connection with the ski binding described in FIGS. 1 to 4, inclusive, the swivel rods 2*a* are reciprocable lengthwise of their sleeves. In this instance, instead of a rearward force being exerted on the swivel rods by a tension spring, such force is produced by one or more bow springs 20. The central portion of each bow spring is engaged by a lug 21 projecting upward from a longitudinal bar 22. This bar is restrained from transverse movement relative to the ski by straps 22*a* and 22*b* extending over it, but it can be adjusted lengthwise relative to the ski to select the desired force to be exerted on the swivel rods 2*a* opposing their movement longitudinally of the ski.

One edge of the bar 22 is provided with rack teeth 23 engageable with the teeth of a pinion 24 mounted on the ski. The bar 22 can be adjusted lengthwise by turning the pinion. Such turning can be effected by providing a cross slot 25 in the head of the pinion with which a cross on the end of a ski pole can be engaged to serve as a turning tool. Even after the ski boot B has been placed on the footplate 9, as shown in FIG. 5, and its sole engaged by the toe clips 3 and 4, the force applied by the bow spring or springs 20 can be adjusted by shifting the longitudinal bar 22 lengthwise in one direction or the other by turning the pinion 24 in this manner.

In order to be able to establish a desired spring force setting and to duplicate such spring force reliably from one use of the ski to another, graduation marks 26 can be provided along the edge margin of bar 22 opposite the rack teeth 23 for cooperation with an index 26*a*. Such graduations can be appropriately numbered if desired.

The outer ends of the bow spring or springs 20 do not bear directly on the swivel rods 2*a*, but their force is transmitted to such rods through the structure of toe clips 3 and 4. Each of these toe clips includes a sleeve 3*a* or 4*a* turnable on an upturned end 2*h* of a swivel rod. The sole-engaging portion of the toe clip projects rearwardly from the upper portion of such sleeve. An extension 3*b* extends forwardly from the lower portion of sleeve 3*a*, and an extension 4*b* extends forwardly from the lower portion of sleeve 4*b* in positions for their forward ends to be engaged by the opposite ends, respectively, of the bow springs 20. The rearward force of such spring or springs is therefore transmitted through the extensions 3*b*, 4*b* and the sleeves 3*a*, 4*a* of the toe clips to the upturned portions 2*h* of the swivel rods.

The torsion springs 18 and 19 resisting turning of the swivel rods *2*a for rocking of the toe clips 3 and 4 out of engagement with the ski boot sole are not relied upon alone to maintain the clips in engagement with the boot sole. In addition, compression springs 28 are engaged between opposite sides of the longitudinal bar 22 and the extensions 3*b* and 4*b* of the the toe clips 3 and 4, respectively. When the toe clips are not in engagement with the sole of a ski boot, their inward swinging is limited by engagement of stop lugs 3*c* and 4*c* projecting from the toe clip sleeves 3*a* and 4*a*, respectively, and engageable with stop pins 39*a* carried by the ski and upstanding from it.

The force exerted by the compression springs 28 on the extensions 3*b* and 4*b* of the toe clips 3 and 4 can be adjusted to some extent simultaneously with adjustment of the lengthwise force exerted by bow spring or bow springs 20 by lengthwise shifting of the longitudinal bar 22. For this purpose, the inner ends of springs 28 engage opposite sides of a wedge 27 carried by the bar which tapers rearwardly. As the longitudinal bar is shifted rearwardly by rotating pinion 24, the force exerted by the bow spring or bow springs 20 will be increased and simultaneously longitudinal movement of the wedge will move the inner ends of springs 28 outwardly so that their force on the toe clip extensions 3*b* and 4*b* will be increased.

In the ski binding of FIGS. 5 and 6, the longitudinal bar 22 is connected to the heel binding H for the purpose of tripping this binding to release the heel of the ski boot substantially simultaneously with release of the toe. For this purpose, the longitudinal bar 22 carries a crossbar 22*c* having its end portions arranged in alignment with the swivel rods 2*a*. When either of these swivel rods is turned sufficiently so that the sole clip 3 or 4 is released from engagement with the toe portion of the boot sole, the bow spring 20 can drive one or both of the swivel rods 2*a* rearward to strike the crossbar 22*c* for shifting the rear portion of such crossbar rearwardly.

Rearward shifting of the bar 22 can shift the keeper 22*e* out of engagement with the latch leaf 22*f* so that the heel binding H can swing upward about its hinge H*a* to release the heel.

Figure 7:
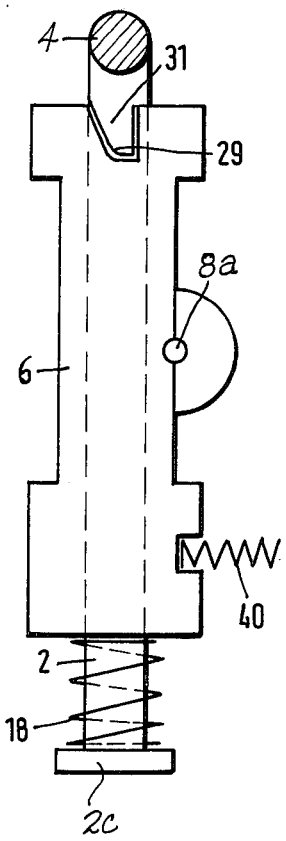
FIGS. 7, 8 and 9 are plans of different forms of a component of the ski binding.
Figure 8:
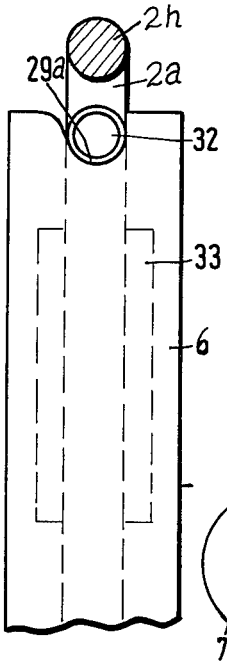
Figure 9:
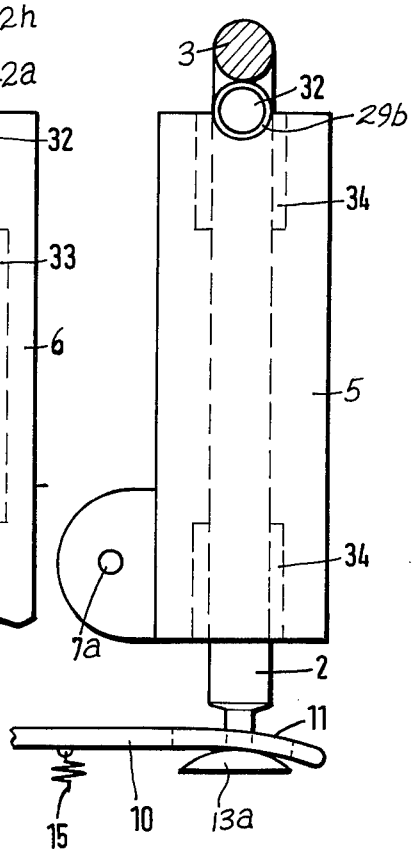

The components shown in FIGS. 7, 8 and 9 can be used with various types of ski bindings in accordance with the present invention. These structures enable a ski binding designer to select the characteristics of the ski binding best suited for the particular use of the ski. Especially, these structures enable the ski binding to be designed to be released under different overstress conditions.

The component shown in FIG. 7 can be used in the ski binding structure shown in FIGS. 1 to 4. In this particular instance, the left toe clip assembly is shown. The swivel rod 2 carrying the toe clip 4 is received in the guide sleeve 6 for swiveling about the axis of the rod 2 and for longitudinal movement through the sleeve, as described in connection with the ski binding of FIGS. 1 to 4. In this instance, however, the sleeve 6 is swingable about a pivot 8*a* located generally centrally between the ends of the guide sleeve. The compression spring 40 urges the guide sleeve 6 in the direction to swing its forward end inwardly, as described in connection with FIGS. 1 to 4.

The component shown in FIG. 7 differs from the corresponding component shown in FIGS. 1 to 4, inclusive, principally in having a notch 29 in the forward end of the guide sleeve 6, the outer side of which notch is inclined forwardly and outwardly toward the left ski edge. The swivel rod 2 or shank 4 of the toe clip has a stop lug 31 that engages in the notch 29 and has a profile complemental to the shape of the notch. While the swivel rod 2 could be urged rearwardly by a spring arrangement such as shown in the ski binding of FIGS. 1 to 4, inclusive, the component of FIG. 7 is shown as having a compression spring 18 encircling the swivel rod 2 and having its opposite ends engaged with a head 2*c* on the end of the swivel rod and with the rearward end of the guide sleeve 6.

As long as the stop lug 31 is engaged in the notch 29 of the guide sleeve 6, the rod 2 cannot swivel to rock the toe clip 4 into released position. Release of the toe clip can be effected, however, when the swivel rod is shifted forwardly a distance sufficient to enable the lug 31 to clear the notch when the rod swivels. Such forward movement can be accomplished in opposition to the rearward force of the spring 18 by the ski boot exerting a sufficient force on the sole clip directly forwardly, such as by inertia of the skier's body when the ski strikes an obstruction, or by an excessive force exerted laterally by the ski boot to the left, or by a combination of such lateral and forward forces. Lateral force will cause the complemental inclined surfaces of the stop lug 31 and the notch 29 to wedge the swivel rod forward until the lug 31 has cleared the notch 29.

If a quicker release of the toe clip under overstress conditions is desired, the spring 18 may be a combined compression and torsion spring reacting between the swivel rod head 2*c* and the guide sleeve 6. Such spring will be arranged to exert a force tending to turn the swivel rod in a direction to rock the toe clip 4 outward. Such torque will press the inclined surface of the lug 31 against the inclined surface of the notch 29 to assist to some extent by wedging the swivel rod forward, but more specially, as soon as the swivel rod has been moved forward far enough so that lug 31 will clear notch 29 the spring will exert a positive force for rocking the toe clip out of engagement with the ski boot sole to free the ski boot from the binding.

The component shown in FIG. 8 can be used with a ski binding of the type shown in FIGS. 5 and 6 and is illustrated as being the left component. In this instance, the swivel rod longitudinal portion 2*a* carried a stop roller 32 engageable in a complementally shaped notch 29*a* in the forward end of the guide sleeve 6. Again, as long as the roller is engaged in the guide sleeve notch the toe clip cannot swivel into released position. The outer edge of the notch is shown as being rounded to facilitate escape of the stop roller from the notch toward the outside. Alternatively, the outer side of the notch could be inclined to a greater or lesser extent to facilitate forward wedging movement of the horiziontal portion of the swivel rod 2*a*.

As described in connection with FIG. 7 a torsion spring 18 could be connected between the swivel rod horizontal portion 2*a* and the guide sleeve 6 to facilitate and expedite release of the toe clip. Swiveling and lengthwise movement of the swivel rod portion 2*a* relative to the guide sleeve 6 can also be facilitated by providing a grease pocket 33 between the swivel rod and the guide sleeve.

FIG. 9 shows a component somewhat similar to that of FIG. 8, but it is better adapted for use in the ski binding of the type shown in FIGS. 1 to 4, inclusive. In this instance, the component would be located adjacent to the right edge of the ski, although the pivot 7*a* for the guide sleeve 5 connects a lug on the inner side of the rearward end of the sleeve to the ski, instead of such lug being on the outer side of the sleeve rearward end, as shown in FIGS. 2 and 4. The arrangement for exerting a rearward pull on the swivel rod 2 by utilization of the crossbar 10 and tension spring 15 has been described in connection with FIGS. 1 to 4. In this instance there is a slight variation in the shape of the head 13*a* on the end of the reduced portion of the swivel rod.

Instead of relying simply on the force of spring 16 to hold the toe clips in engagement with the ski boot sole, engagement of roller 32 carried by the swivel rod 2 with the complemental notch 29*b* in the forward end of the guide sleeve 5 will prevent the rod from swiveling relative to the guide sleeve until after the swivel rod has been shifted forwardly sufficiently so that the stop roller will clear the notch 29*b*. Consequently, the toe clip 3 will be held reliably in engagement with the ski boot sole until either the ski boot overstresses the binding in a forward direction or the ski boot has swung sidewise relative to the ski sufficiently to cause the inclined edge 38*a* at one end or the other of the edge 38 to move the swivel rod 2 forward sufficiently so that stop roller 32 clears the notch 29b, or a combination of these effects has occurred which will move the stop roller 32 out of the notch 29*b*.

Figure 10:
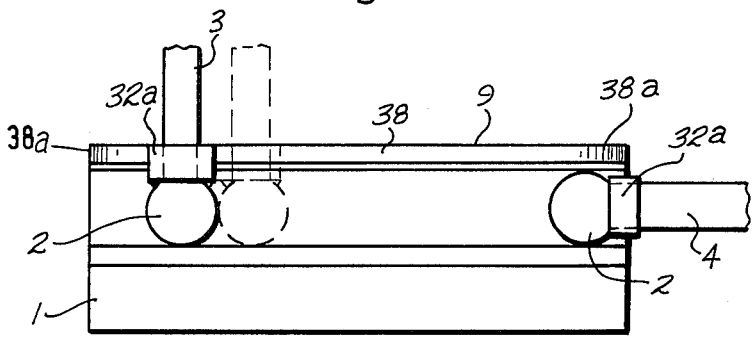
FIG. 10 is a vertical transverse section through a ski showing parts of a ski binding according to the present invention.
Figure 11:
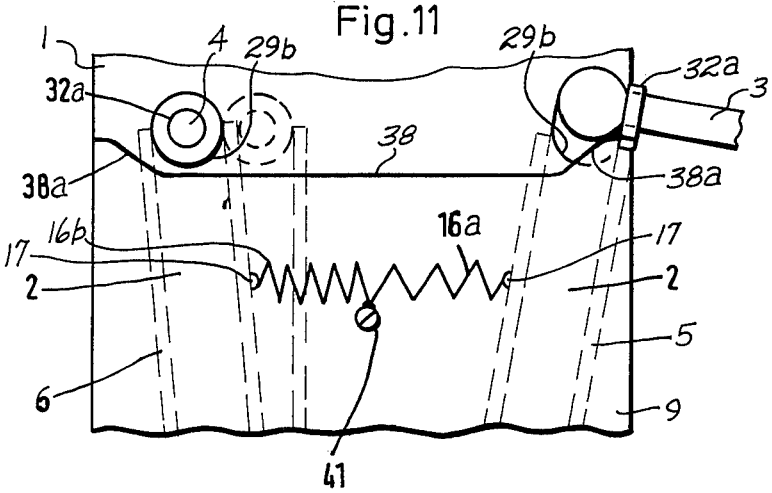
FIG. 11 is a plan of the structure shown in FIG. 10.

FIG. 10 and 11 show a slight modification of the ski binding illustrated in FIGS. 1 to 4 and 9. In this instance, the rollers 32*a* are mounted on the stems of the toe clips and are of a sufficient width both to engage in a notch 29*b* in the forward end of a guide sleeve as described in connection with FIG. 9 and to engage a forwardly and outwardly inclined portion 38*a* of the forward edge 38 of the ski footplate 9. The guide sleeves are not shown in FIG. 10, and the parts are illustrated in the same position as shown in FIG. 4 viewed from the left. The left sole clip has been swung downward into released position.

In FIG. 11 the right sole clip is shown as being swung down into released position. The structure of this figure differs from that shown in FIGS. 1 to 4 not only in showing the cooperating stop rollers 32*a* and notches 29*b*, but also in providing a spring connecting the right and left guide sleeves 5 and 6 having centering characteristics. For this purpose the connecting spring includes a right section 16a and a left section 16*b*, the adjacent ends of which sections are secured to the ski 1 by an anchor 41. When the guide sleeves 5 and 6 are swung conjointly relative to the ski by turning of the foot, therefore, the stress in one of the spring sections 16*a* and 16*b* will be increased so as to tend to return the ski boot to a centered position on the footplate 9.

Figure 12:
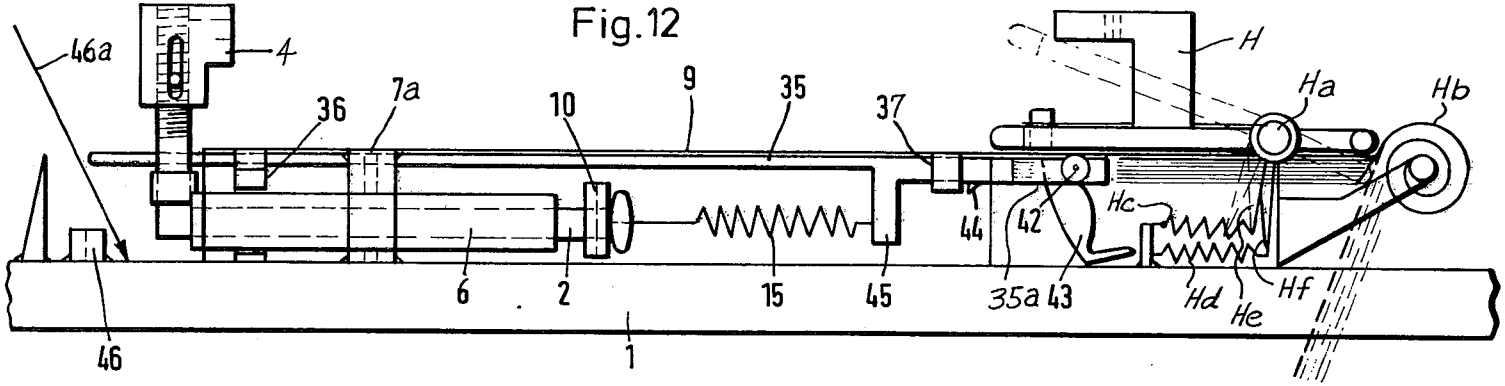
FIG. 12 is a vertical longitudinal central section through another type of ski binding according to the present invention.
Figure 13:
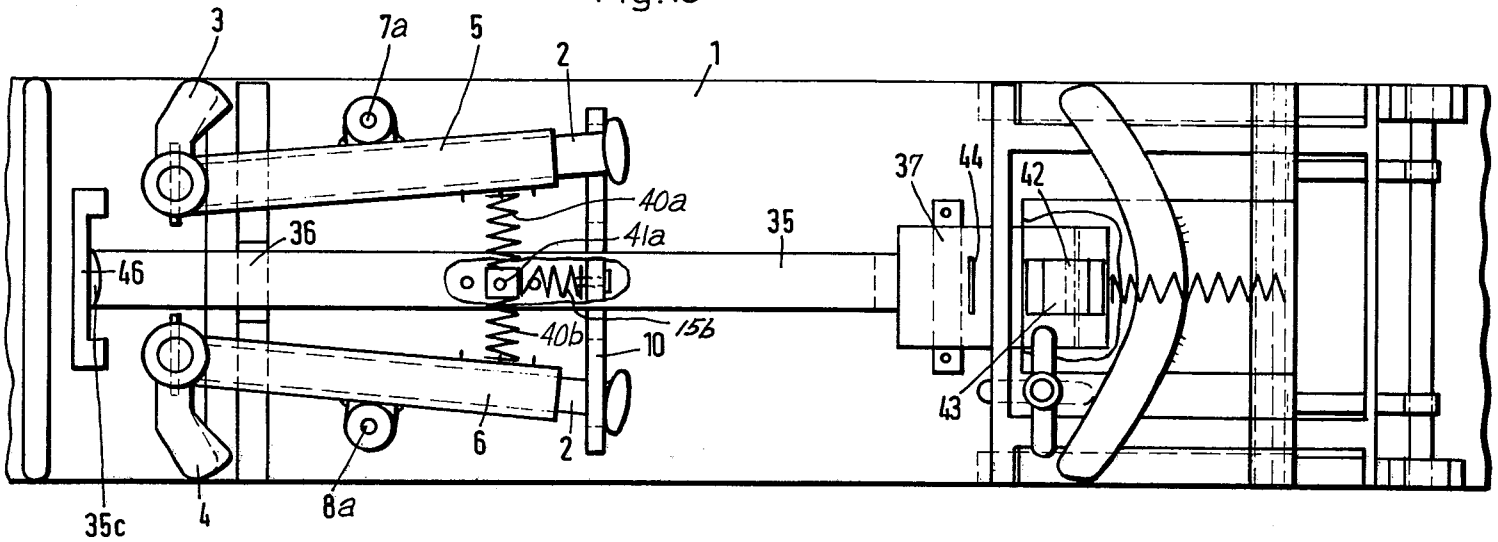
FIG. 13 is a plan of such mechanism with parts broken away.

FIGS. 12 and 13 show a heel binding that can be utilized conveniently with a toe binding of the type shown in FIGS. 1 to 4, inclusive, and which requires only a minor modification of such toe binding. The ski binding of FIGS. 12 and 13 includes a longitudinal bar 35 located immediately beneath the footplate 9. The forward portion of such longitudinal bar is suspended by a forward strap 36 from the footplate and the rear portion of such bar is suspended from such footplate by a rear strap 37. Forward movment of the longitudinal bar is limited by engagement of a stop lug 44 carried by the bar with the rear suspension strap 37.

The only change in the toe binding of FIGS. 1 to 4 required to be made for use of the heel binding structure shown in FIGS. 12 and 13 is for the rearward end of the spring 15 to be connected to the projection 45 extending downward from the longitudinal bar 35 instead of being connected to a projection depending directly from the footplate 9. There are certain other modifications of the front binding shown, however, including the guide sleeves 5 and 6 being mounted on central pivots 7*a* and 8*a* similar to the central pivot shown in FIG. 7. Also the transverse compression spring acting on the two guide sleeves 5 and 6 has two sections 40*a* and 40*b*, the adjacent ends of which are secured to the ski 1 by an anchor 41*a*. Such anchor also secures one end of a compression spring 15*a*, the other end of which is secured to the crossbar 10.

The rear portion of the longitudinal bar 35 has in it an aperture through which an arm 43 mounted on the bottom of the heel binding H can project downward. Such arm can be moved downward through such aperture and withdrawn upward through such aperture by swinging of the heel binding H about its pivot H*a*. Normally the heel binding is urged to swing upward by a torsion spring H*b* and/or by one or more tension springs H*c* and H*d* connected to lever arms H*e* and H*f*, respectively, projecting downward from the heel binding.

A latch roller 42 is mounted in the rear portion of the aperture 35*a* for accommodation in a complemental recess of the arm 43 when such arm is in its lower position. Engagement of the roller in the arm recess will hold the heel binding H down in the heel-retaining position shown in FIG. 12. Rearward movement of the longitudinal bar 35 will shift the roller 42 rearwardly a distance sufficient to enable the arm 43 to move upwardly through the aperture 35*a*. Such upward movement is accomplished by tilting of the heel binding H about its pivot H*a* as a result of the force exerted on the heel binding by the torsion spring H*b* and/or the tension springs H*c* and H*d*.

Normally, the heel binding H will be held securely in its gripping position by the locking roller 42 being pressed forwardly into the latching notch of the arm 43 by the force of spring 15 pulling projecting 45 forward. The wearer may release the heel binding latch at will, however, by sliding the longitudinal bar rearward in opposition to the force of spring 15. Such rearward sliding can be accomplished readily by the wearer if the forward end of the longitudinal bar 35 extends forwardly beyond the footplate 9 and the top clips 3 and 4 as shown in FIGS. 12 and 13. Preferably the forward end of such bar has in it a broad concave notch 35*c*.

Directly beneath the forward end of the longitudinal bar 35 is a reaction cleat 46 secured on the upper side of the ski 1. The tip of a ski pole can be inserted rearwardly and downwardly past the forward end of the longitudinal bar 35 and behind the reaction cleat. Rearward swinging of the upper end of the ski pole will cause its lower end portion to engage in the notch 35*c* in the forward end of the longitudinal bar 35 and pry such bar rearwardly to release the roller 42 from the latch notch of the arm 43 so that the heel binding H will be swung upwardly as the ski boot heel is raised to release the heel from the binding.

Figure 14:
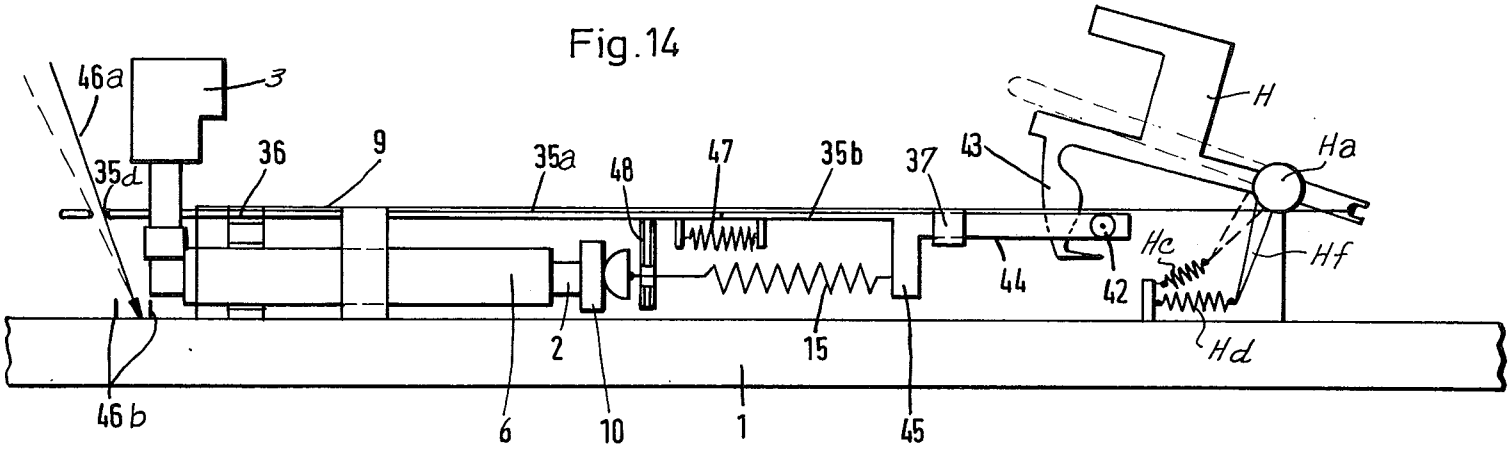
FIG. 14 is a vertical longitudinal central section through a ski binding generally of the type shown in FIGS. 12 and 13 but somewhat modified.
Figure 15:
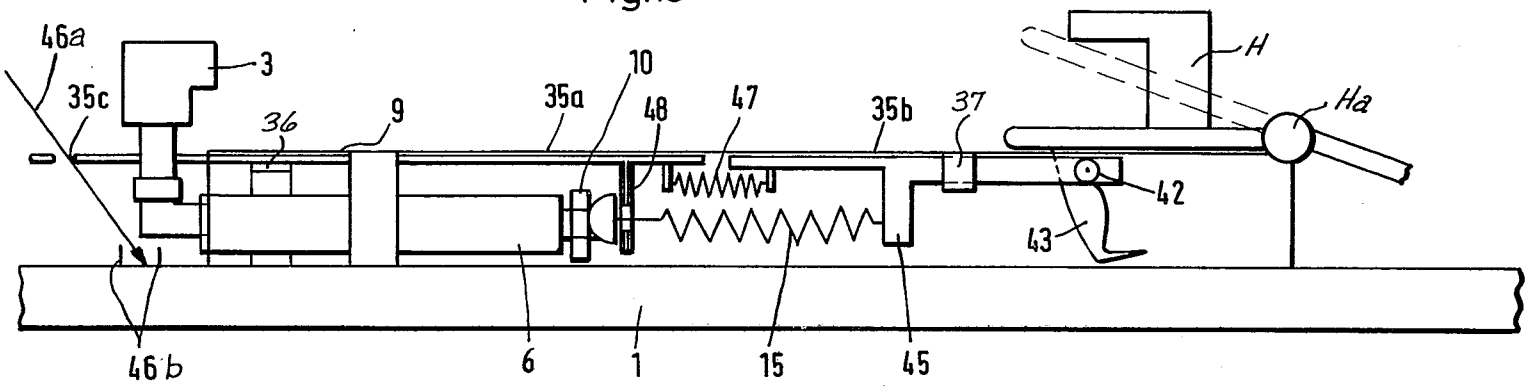
FIG. 15 is a similar view showing parts in different operative positions.

The structure shown in FIGS 14 and 15 enables both toe bindings of the type shown in FIGS. 1 to 4 and FIGS. 12 and 13 and heel binding of the type shown in FIGS. 12 and 13 to be released easily and quickly by the wearer instead of being releasable only by overstress. As in the construction shown in FIGS. 12 and 13 the device again has longitudinal bar means located immediately below the footplate 9 and suspended from it. In this instance, the longitudinal bar means is divided into a forward bar section 35*a* and a rearward bar section 35*b*, the adjacent ends of which are interconnected by a tension spring 47. The projection 45 to which the tension spring 15 is connected projects downward from the rearward section 35*b*. The forward bar section 35*a* has a downward projection 48 with an aperture in it through which an end tie of the tension spring 15 extends.

The forward end of the forward bar section 35*a* projects forwardly beyond the front end of the footplate 9 and the toe clips 3 and 4 and has in it an aperture 35*d*. At a location beneath the forward end of the bar section 35*a* and somewhat rearwardly of the aperture 35*d*, cleats 46*b* are mounted on the upper surface of the ski 1 spaced apart lengthwise sufficiently to accommodate between them the tip of a ski pole inserted downwardly through the aperture 35*d*.

By inserting the tip of the ski pole 46*a* through the aperture 35*d* in the forward end of the bar section 35*a*, the wearer can easily release both the toe binding and the heel binding either to remove the ski expeditiously or to test the functioning of the overstress sole-releasing mechanism. If the bar section 35*a* is pried rearwardly as described in connection with FIGS. 12 and 13, the rearward end of such forward section will abut the forward end of the rearward section 35*b* to shift it rearwardly into the position shown in FIG. 14 for releasing the heel binding H. Alternatively, if the upper portion of the ski pole 46*a* is swung forward with its tip end against the rear cleat, the forward bar section 35*a* will be drawn forward until the downward projection 48 engages the crossbar 10 and pushes it and the swivel rods 2 forward a distance sufficient to enable or effect outward swiveling of the toe clips 3 and 4 to release the toe of the ski boot.

Figure 16:
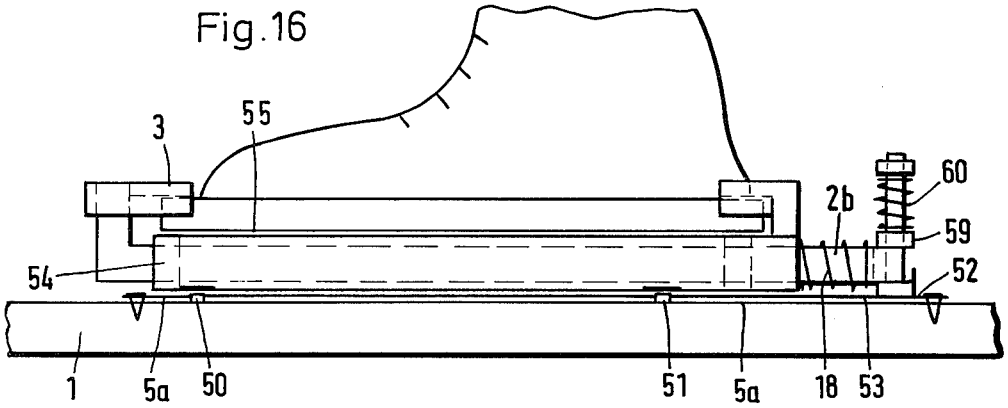
FIG. 16 is a side elevation of another type of ski binding according to the present invention.
Figure 17:
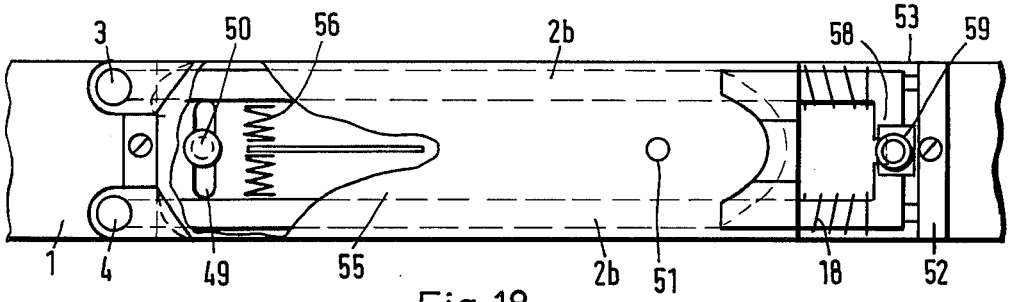
FIGS. 17, 18 and 19 are plans of such ski binding with parts shown in different operating positions and having parts broken away.

In the types of ski binding discussed thus far, the footplate has side flanges extending downward to protect the mechanism of the binding described. As an alternative type of construction, the ski binding mechanism can be enclosed in a casing having a bottom, as well as sides, and a footplate top. Such a casing is shown in FIGS. 16 to 21, inclusive, as including a bottom 53, opposite sides 54 and a top 55, serving as a footplate as shown in FIG. 16. Such casing carries both the toe binding and the heel binding which can be generally of the type described above.

Instead of the swivel rods 2*b* being independently swingable relative to the ski like the swivel rods in the ski binding of FIGS. 1 to 4, inclusive, the swivel rods are always maintained in parallel relationship as are the swivel rods 2*a* in the ski binding of FIGS. 5 and 6. In the ski bindings of FIGS. 16 to 21, inclusive, however, the swivel rods 2*b* can have an effective conjoint swinging movement relative to the ski 1 because the casing which contains such swivel rods is mounted on the ski by a pivot 51 enabling the entire casing and the swivel rods housed within it to be swung relative to the ski about the upright axis of the pivot perpendicular to the ski.

Preferably the pivot 51 is located rearwardly of the center of the casing approximately under the center of the heel of the ski boot so that the foot of the wearer can pivot on its heel relative to the ski. Such pivot is carried by base plate 52 mounted on the upper surface of the ski beneath the casing. The bottom of the casing has in it an arcuate guide slot 49 concentric with the axis of pivot 51 for receiving a pin projecting upward from the base plate 52. The length of the guide slot is selected so as to limit the swinging of the casing about pivot 1 to the desired degree. A centering spring 56 also carried by the base plate 52 has its central portion connected to the base plate and tends to center the casing relative to the base plate.

The two swivel rods 2*b* are received in guide sleeves mounted fixedly in spaced parallel relationship in the casing for swiveling and longitudinal movement relative to such guide sleeves as described above. The forward ends of the swivel rods project forwardly beyond the front end of the casing and carry the toe clips for swiveling in the manner described above. The rearward ends of the rods 2*b* also project beyond the rearward end of the casing and have inwardly bent end portions 58 shown best in FIGS. 20 and 21. These inwardly projecting portions extend beneath a slide collar 59 when the rods 2*b* are held in their rearmost positions by compression springs 18 reacting between the end portions 58 and the guide sleeves in which the swivel rods 2*b* are received.

The collar 59 is slidable on an upright post 59*a* carried by the bottom 53 of the casing. The upper portion of the post is threaded to receive a nut 59*b*. A compression spring 60 is interengaged between the collar 59 and the nut for urging the collar downward. The degree of downward force exerted by the compression spring 60 can be increased by screwing the nut 59*b* downward or decreased by unscrewing such nut. During normal skiing the collar 59 will hold the bent ends 58 of the swivel rods in their lower positions of FIGS. 17 and 20. If the ski boot should apply a sufficiently great force on the ski first to swing the casing against the force of springs 56 to engage an end of slot 59 with a pin 50 and then exert an additional amount of force so that the pressure on a toe clip will swing a bent end 58 upward in opposition to the pressure of spring 60 on collar 59 a distance sufficient to enable the end of such bent portion to pass the collar, such bent end and the toe clip mounted on its swivel rod 2*b* will continue to swivel so that the toe clip will rock outwardly to release the ski boot from the ski. Alternatively, if the ski boot exerts a sufficiently great force forward on either of the toe clips 3 and 4, the swivel rod or rods 2*b* will be moved forward from the position shown in FIG. 17 to the position shown at the bottom of FIG. 19 so that the bent portion 58 will have slid forward from beneath the collar 59 again freeing the bent end of the swivel rod from the collar. In this instance, also, the toe clip can swivel outward readily to release the ski boot from the ski.

Figure 18:
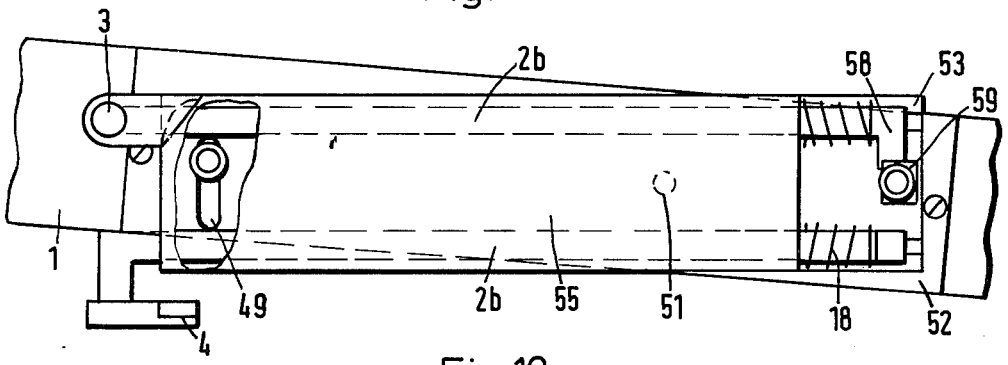
Figure 19:
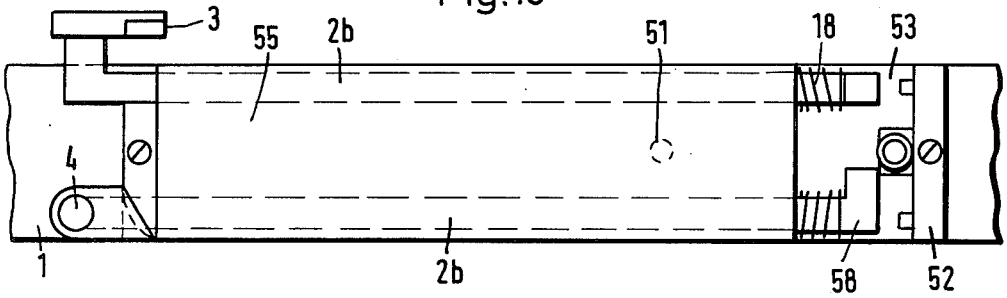
Figure 20:
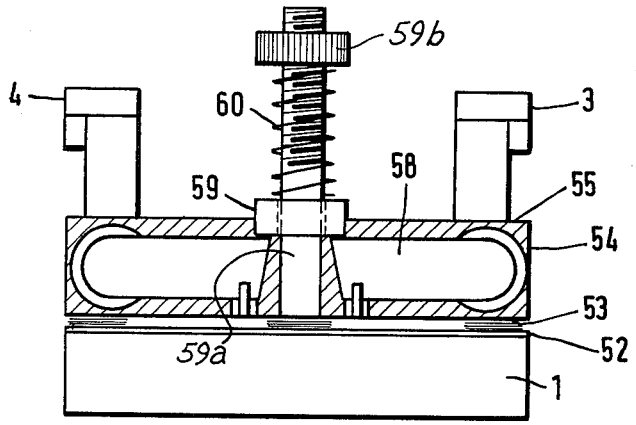
FIGS. 20 and 21 are vertical transverse sections through a ski having binding of the type shown in FIGS. 16 to 19, inclusive, and showing parts in different operative positions.
Figure 21:
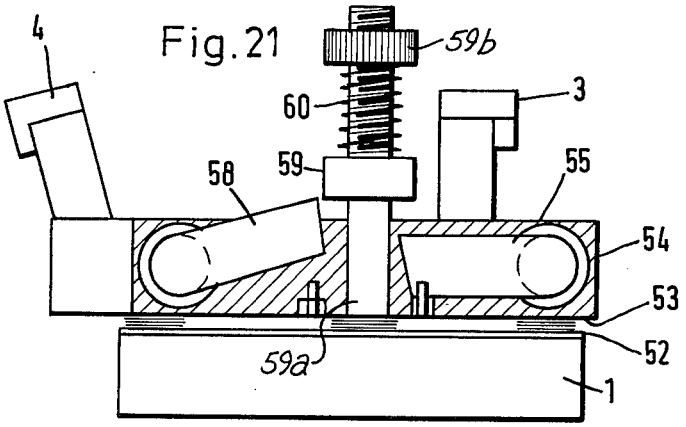

To facilitate release of the ski boot under a condition of overstress, the springs 18 can be torsion springs as well as compression springs and have their opposite ends connected to the swivel rods **2*b* and to the guide sleeves in which such swivel rods are received. The springs will be convoluted in the direction to exert a torque tending to turn the swivel rods within the sleeves for rocking the toe clips outward. When a bent end 58 is freed from the collar 59, therefore, the spring will continue to swivel the corresponding rod 2*b* to swing the toe clip into fully released position. While in normal use, therefore, the casing can swing relative to the ski about its pivot 51 within the limits of the length of slot 49, upon the exertion of a force by the ski boot on the ski either forward or sidewise or both sufficient to move a bent end 58 of the swivel rod out from under collar 59, the corresponding toe clip will swing outward to release the ski boot from the ski. FIG. 18 shows the left toe clip 4 released by excessive lateral pressure of the ski boot, and FIG. 19 illustrates the right toe clip 3** having been released by excessive forward pressure of the ski boot on the ski.

Figure 22:
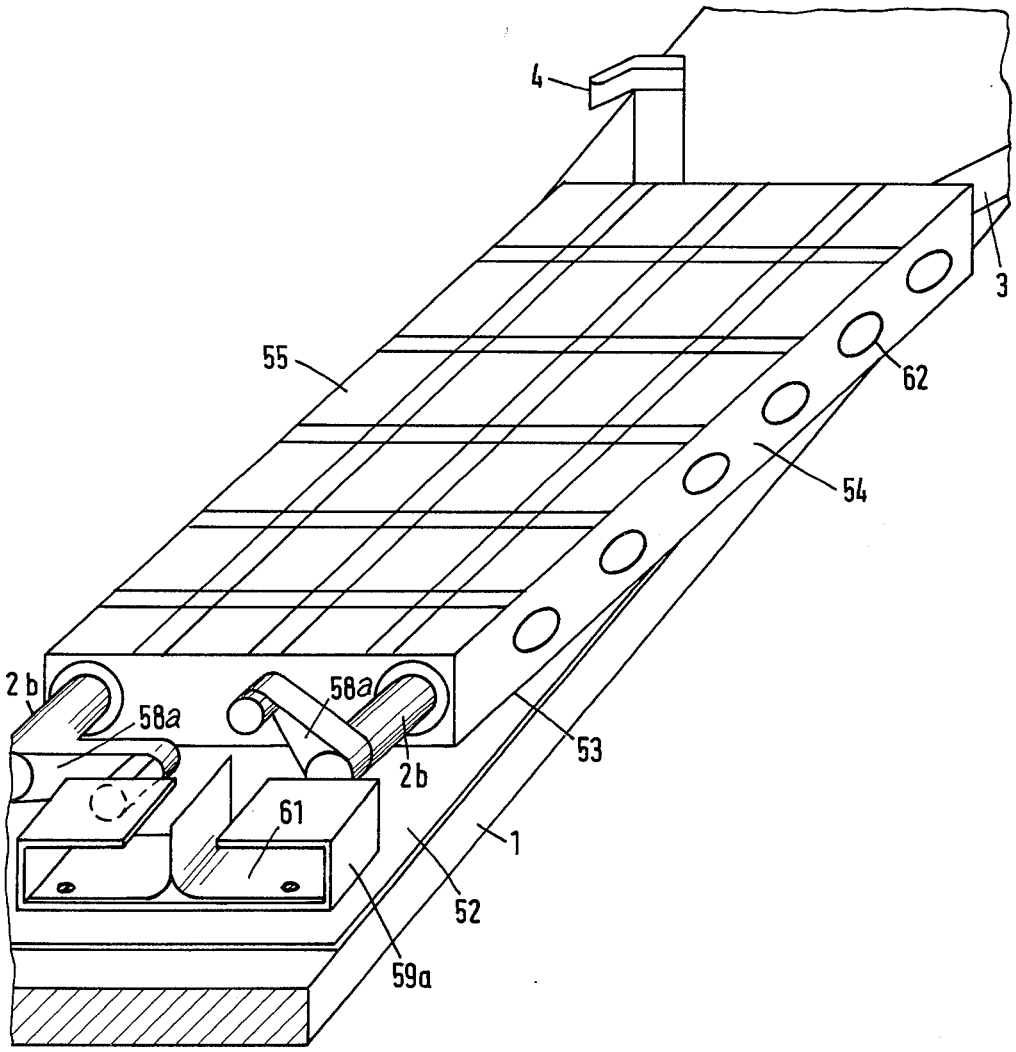
FIG. 22 is a top perspective of a further form of ski binding according to the present invention.

In FIG. 22 cranks **58*a* are mounted on the rearwardly projecting ends of the swivel rods 2*b* instead of such rods simply being bent. These cranks can carry rollers engageable in angle slots 61 of crank holders 59*a*. During limited swinging of the casing relative to the ski, the crank rollers will remain in the horizontal legs of such slots. If the casing has swung excessively relative to the ski, however, a crank roller will ride into the upright portion of its angle slot so that the crank can swing upwardly conjointly with downward rocking of the toe clip on the same swivel rod to release the ski boot from the casing footplate 55**.

In order to lighten the structure of the casing the casing sides 54 can have apertures 62 in them. Also, the footplate 55 can have crossed grooves in it, which serve the dual purpose of lightening the casing structure and also providing channels for escape of snow from between the sole of the ski boot and the footplate. Alternatively, the top plate may simply be a grid of crossed strips which would further lighten the casing structure and enable snow simply to fall through the casing.

Figure 23:
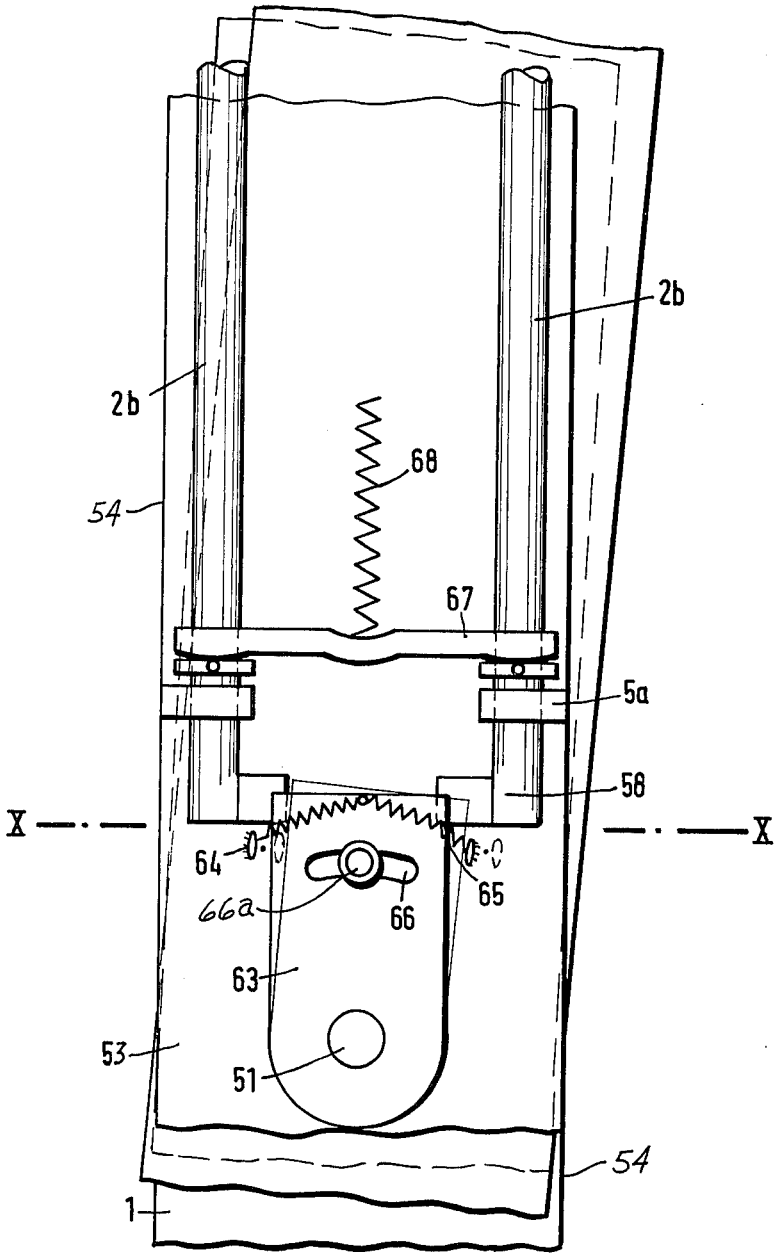
FIG. 23 is a plan of a portion of still another type of ski binding according to the present invention.
Figure 24:
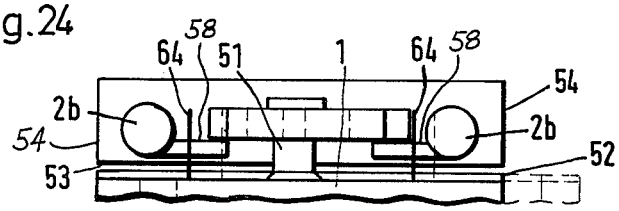
FIG. 24 is a vertical transverse section taken on line X—X of FIG. 23.

In the ski binding of FIGS. 23 and 24, a mounting plate 63 serves the dual function of supporting the casing 53, 54, 55 from the housing and also acting as a latch to hold the bent ends 58 of the swivel rods **2*b* against toe clip releasing swiveling unless the casing swings through an excessive angle relative to the ski. The mounting plate 63 is connected by a pivot 51 to the base plate 52 and has in it an arcuate slot 66 receiving pin 66*a* carried by the base plate. Stops 64 also carried by the base plate are engageable by the mounting plate 63 to limit its angle of swing relative to the ski. The mounting plate 63 is spaced upward from the base plate 52 a distance sufficiently great to receive beneath the forward end of such mounting plate the rear bent ends 58** of the swivel rods.

If the casing swings relative to the ski about pivot 51 conjointly with the mounting plate 63 between the stops 64, the mounting plate will hold the bent ends 58 confined so that rods **2*b* are held against swiveling; but if the casing swings through an angle sufficiently greater than the angle of the swing permitted by the stops for the mounting plate, the bend end 58 of a swivel rod 2*b* can escape from beneath the forward end of the mounting plate 63, as indicated by the cross-hatched position in FIG. 23, and the rod 2*b*** can swivel and enable the toe clip to rock into boot-releasing position.

In FIG. 23 a crossbar 67 engages projections on the swivel rods **2*b* and a compression spring 68 pressing against the central portion of such cross bar urges the swivel rods rearwardly so that their bent ends will be maintained under the forward end of the mounting plate 63** unless the ski boot exerts an excessively great forward force on the toe clips.

Figure 26:
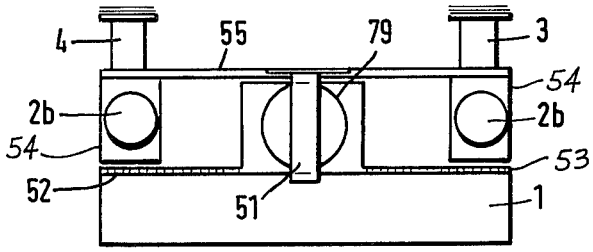
FIG. 26 is a vertical transverse section taken through such mechanism on line III—III of FIG. 25.
Figure 25:
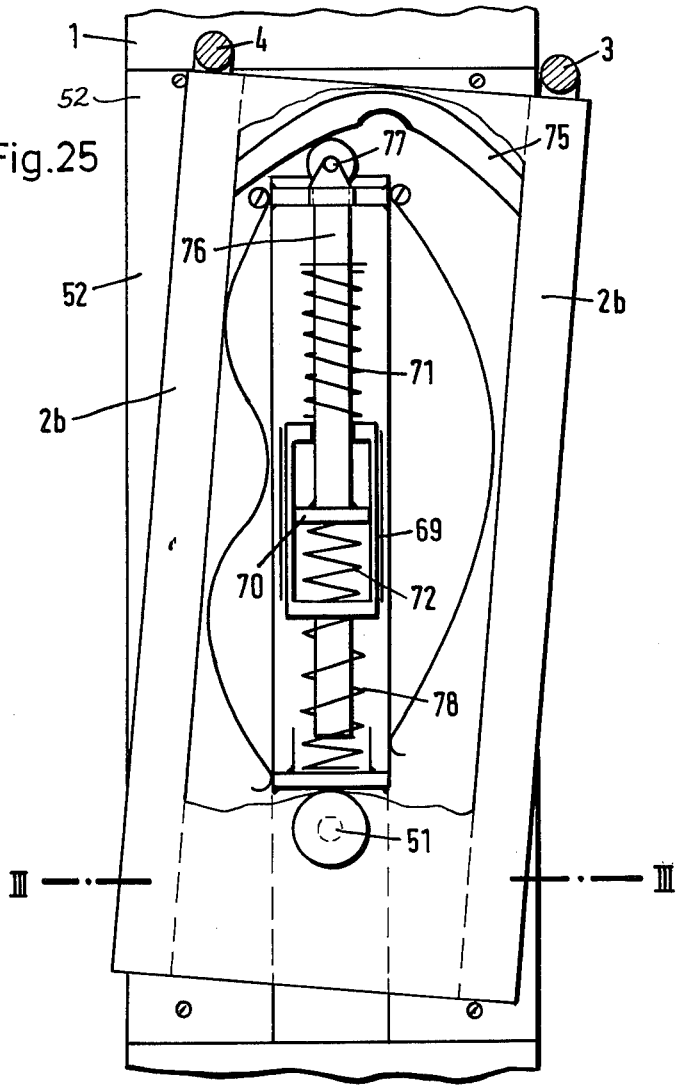
FIG. 25 is a plan of another type of ski binding according to the present invention.

The ski binding of FIGS. 25 and 26 has a centering device including a cylinder 69 mounted on the base plate and receiving a piston 70. The piston is urged outwardly of the cylinder by a light compression spring 71 encircling the piston rod exteriorly of the cylinder and a comparatively strong compression spring 72 within the cylinder engaged between the end of the cylinder and the piston. The piston has a piston rod 76 which carries a roller 77 on its forward end engageable with a bent track 75 mounted in the casing 53, 54, 55. Such track has a sharper concave curvature than a circular arc having the axis of pivot 51 as a center. The central portion of such track has in it a centering notch for receiving the roller 77. The entire piston assembly can be moved toward the track by a further compression spring 78.

The purpose of the centering mechanism shown in FIGS. 25 and 26 is to replace opposed compression centering springs in embodiments of the ski binding described above. In the mechanism of FIG. 25, whenever the casing is swung relative to the ski from centered position the springs 71, 72 and 78 are compressed to a degree depending upon the angle of casing swing.

In order to dampen the swing of the casing relative to the ski to avoid shocks on the foot, the action of the piston 70 and cylinder 69 is provided. This type of centering mechanism can be used in conjunction with any desired type of ski binding such as the examples discussed above, able to release the toe clips if the angle of swing of the casing relative to the ski exceeds a predetermined amount.

Figure 27:
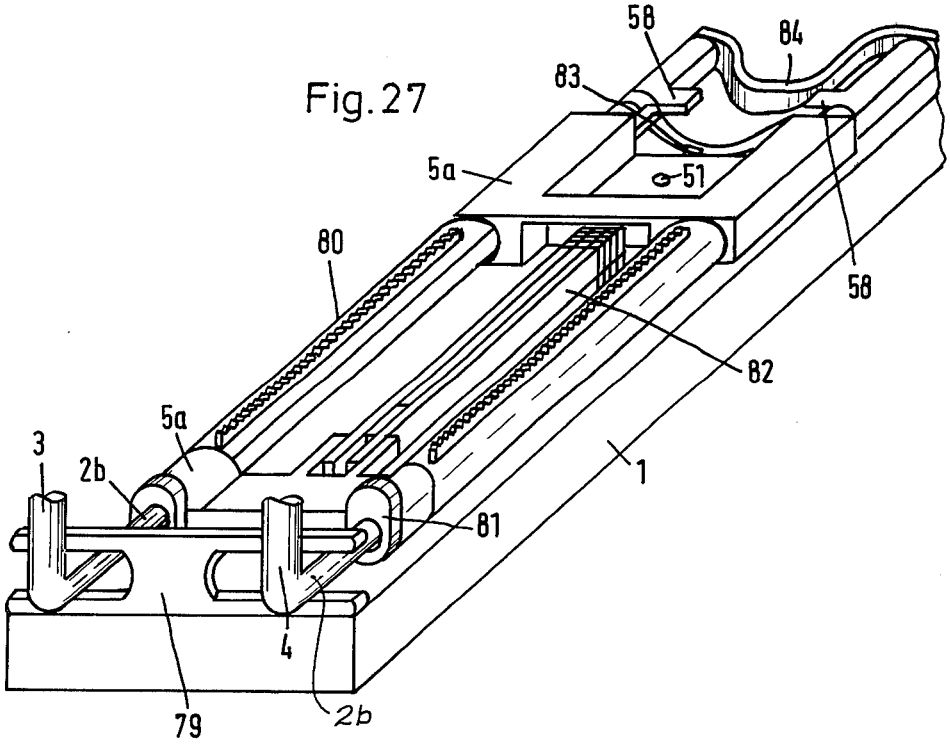
FIG. 27 on the drawing sheet with FIGS. 39 and 40 is a top perspective of still a different form of ski binding according to the present invention, and FIG. 28 on the sheet with FIGS. 33 and 34 is a vertical transverse section through the ski of FIG. 27 showing the ski binding in end elevation.
Figure 28:
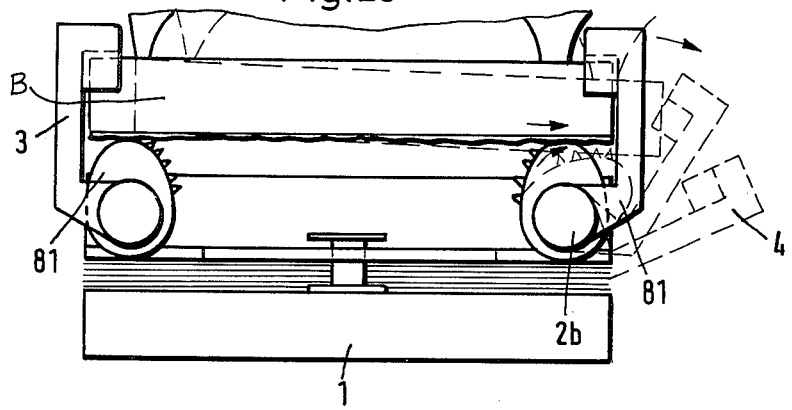

In the device of FIGS. 27 and 28, a ski binding such as discussed above is used. In this instance, however, the forward end portions of the swivel rods **2*b* are received in oppositely-opening guide slots of a transverse guide member 79. The swivel rods 2*b* are held in definitely spaced parallel relationship for swinging conjointly about a pivot 51 relative to the ski, although they are not housed in a casing. Instead of the ski boot resting on a footplate, the boot rests directly on the exposed upper sides of the swivel rods 2*b***. Such rods have a very rough surface so that if an excessively great lateral force is applied by a ski boot to the binding, the contact of the ski boot with the roughened surface of the swivel rod will roll such rod for rocking the toe clip into released position.

In addition, the swivel rods **2*b* carry eccentrics 81 which, as shown in FIG. 28**, support the boot directly. These eccentrics have ribs on them so that sidewise movement of the boot with excessive force will roll the eccentrics to rock the swivel toe clips downward. The eccentric serves the double purpose of causing the toe clip to bear firmly on the boot sole and also, as the eccentric swings and the boot sole follows the toe clip in its downward swing, the spacing between the toe clip and the portion of the eccentric of reduced width will provide clearance for the boot sole so that it will be released more quickly as the clip rocks outward and downward.

The centering spring arrangement in the ski binding of FIGS. 27 and 28 utilizes a plurality of spring strips 82 extending lengthwise of the ski between the swivel rods 2*b*. As the boot support is swung relative to the ski, the spring strips will be stressed and react between the boot support and the ski to return the boot support to centered relationship with the ski. The remainder of the ski binding can be similar to forms of the ski binding described above.

Figure 29:
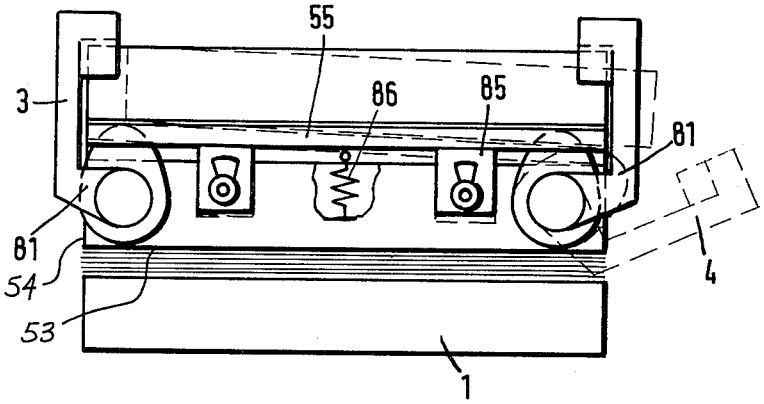
FIG. 29 is a vertical transverse section through a ski showing a different type of ski binding according to the present invention and having parts broken away.
Figure 30:
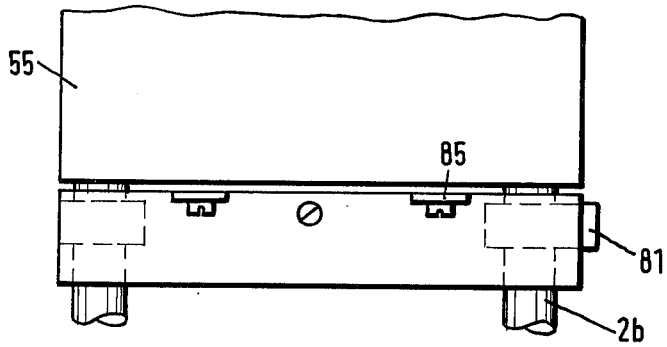
FIG. 30 is a fragmentary plan of the ski binding shown in FIG. 29.

The ski binding of FIGS. 29 and 30 has a casing for housing the ski binding mechanism as described above. In this case, however, the ski binding also has eccentrics 81 similar to those described in connection with FIGS. 27 and 28. In the construction of the ski binding, the footplate 55 is mounted to be depressed as the eccentrics turn, such footplate being held in contact with the upper sides of the eccentrics by a tension spring 86. The footplate is guided for rising and lowering movement by slotted guides 85, the slots of which engage pins carried by the lower portion of the casing.

Figure 31:
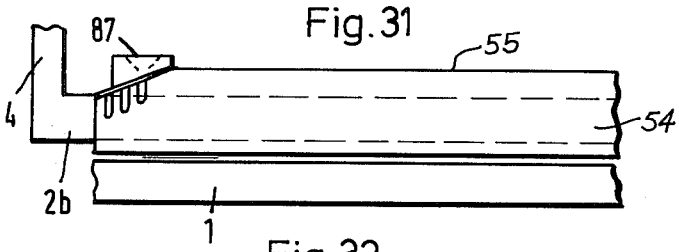
FIG. 31 is a fragmentary side elevation of another ski binding according to the present invention.

In the ski binding of FIG. 31, the boot tip is supported by wedges 87 which are arranged to slide down inclines for depressing the sole of the boot to facilitate it being freed from the toe clips when the boot exerts an excessively great forward force on the ski.

Figure 32:
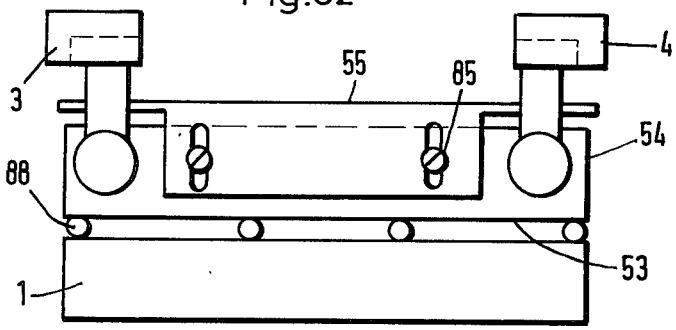

In the ski binding of FIG. 32, the bottom 53 of the casing is supported on strips 88 to reduce the friction between the casing and the base and enable the casing to swing relative to the base more readily for facilitating release of a ski boot.

Figure 33:
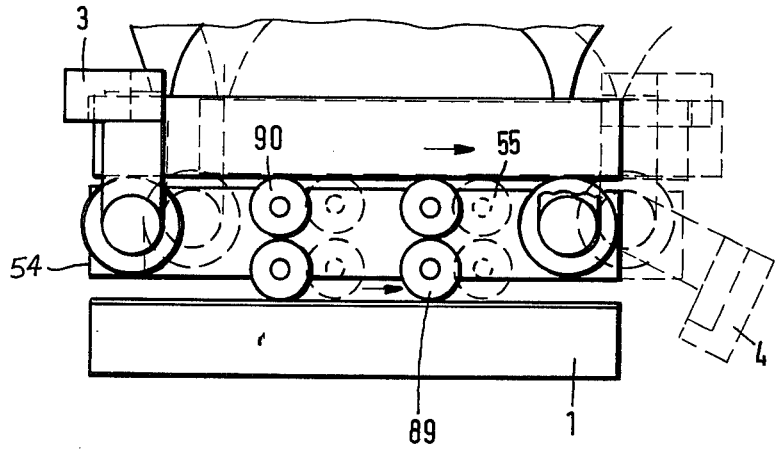
FIGS. 32, 33 and 34 are vertical transverse sections through skis showing end elevation of three different modified forms of ski bindings according to this invention.

In FIG. 33, the ski binding casing is supported by rollers 89 and 90 which replace the strips 88 of FIG. 32 to make it still easier for the casing to swing relative to the ski.

Figure 34:
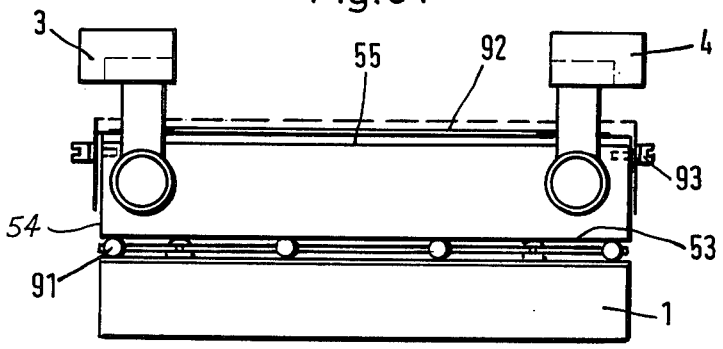

In the ski binding of FIG. 34, the bottom 53 of the casing is supported by roller bearings 91. Also antifriction strips 92 are provided on the footplate to facilitate sliding of the shoe sole relative to the footplate. The height of the footplate can be adjusted and clamped in a desired adjusted position by screws 93 extending through slots in the downwardly projecting side flanges of the footplate.

Figure 35:
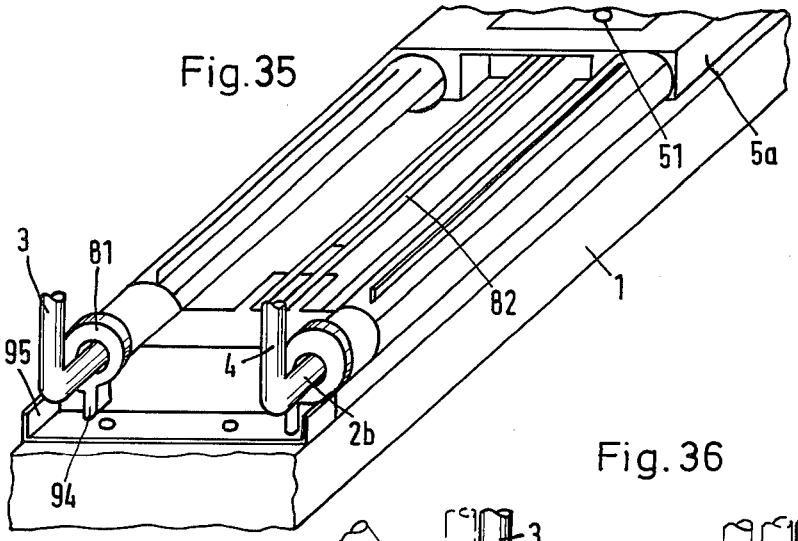
FIG. 35 is a top perspective of another type of ski binding according to the present invention.
Figure 36:
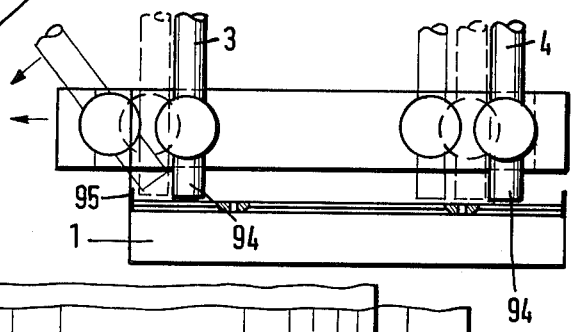
FIG. 36 is a somewhat diagrammatic vertical transverse section through the ski binding shown in FIG. 35.

Tripping of the toe clips is assured by the construction of the ski binding shown in FIGS. 35 and 36. Eccentrics 81 have ribs 94 projecting downward from their lower sides into overlapping relationship with flanges 95 projecting upward from the ski. As the boot support swings through an angle greater than normal about pivot 51 relative to the ski, a downwardly projecting rib 94 will engage an upstanding flange 95. If swinging of the foot support continues, the flange will arrest translatory movement of the rib, causing such rib to effect rotation of the cam 81 by which it is carried, and, consequently, swiveling of a swivel rod 2*b* and rocking of the toe clip carried by that rod into released position. This action is illustrated clearly in FIG. 36.

Figure 37:
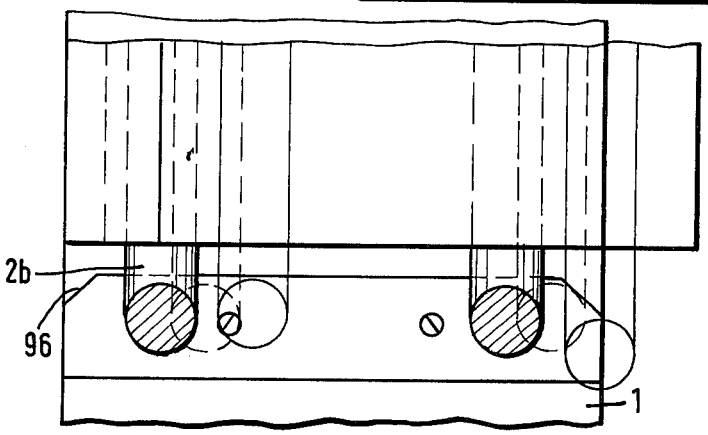
FIG. 37 is a plan of a portion of another ski binding according to the present invention.
Figure 38:
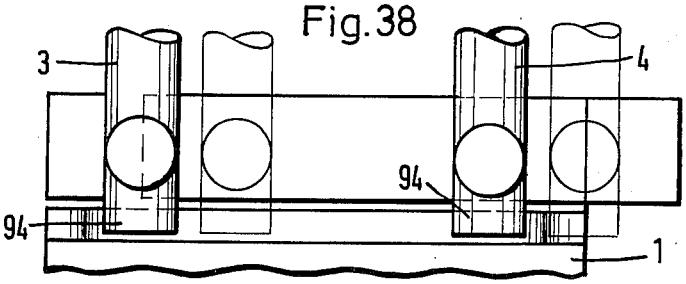
FIG. 38 is a vertical transverse section through the ski showing the ski binding of FIG. 37 in end elevation with parts broken away.
Figure 41:
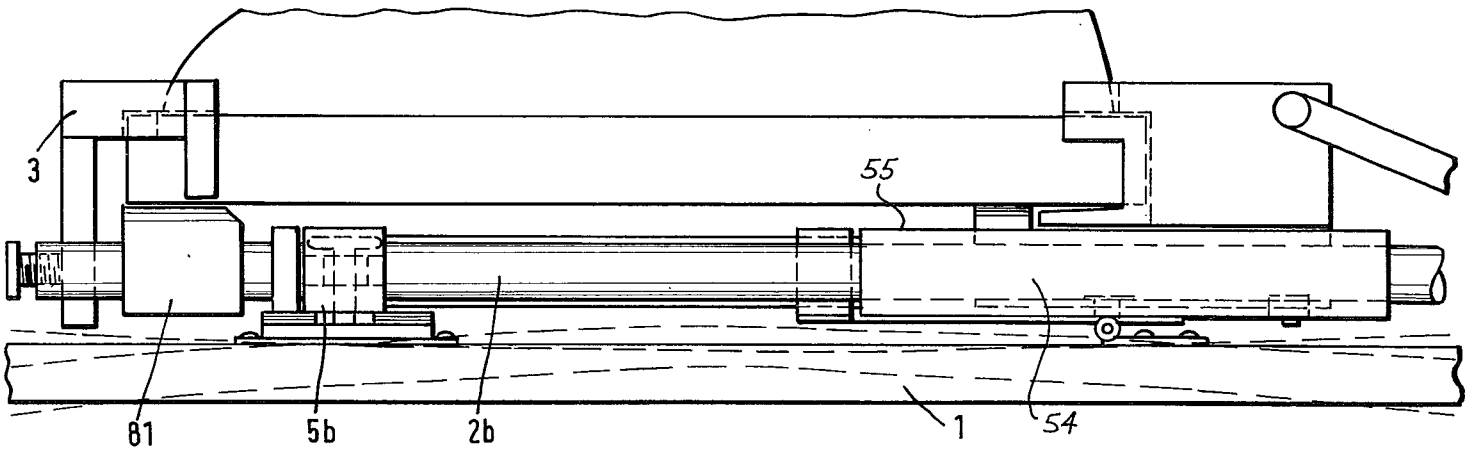
FIG. 41 is a side elevation of another type of ski binding according to the present invention, portions thereof being shown in section.
Figure 42:
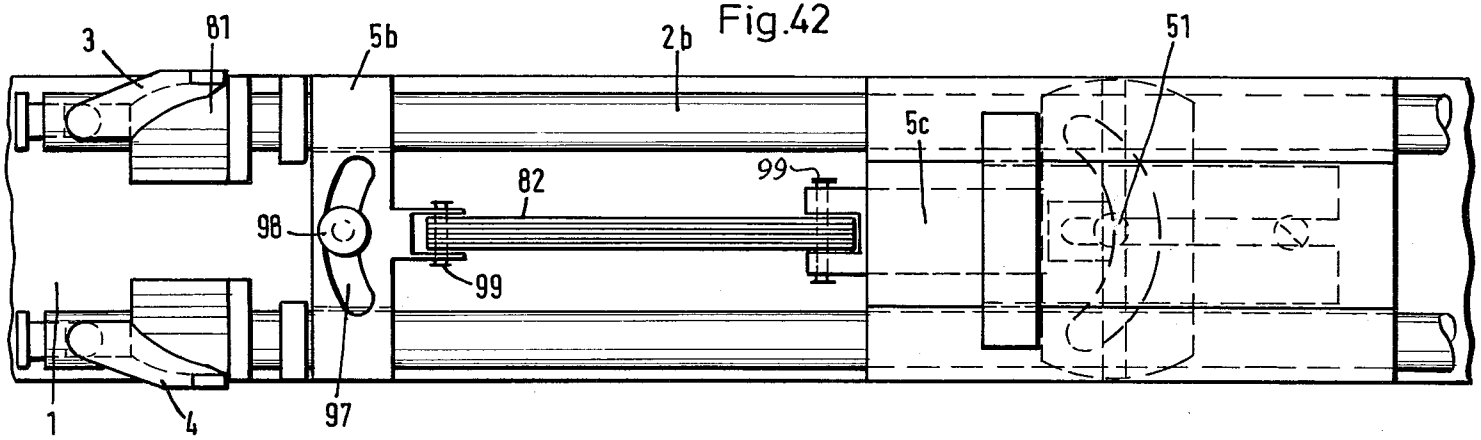
FIG. 42 is a plan of such ski binding with portions shown in section.

In FIGS. 37 and 38, downward projections 94 on the swivel rods 2*b* engage forwardly inclined flanges 96 which wedge the swivel rods 2*b* forward into toe clip swiveling position. Consequently, the toe clips will be released in the manner previously described.

Figure 39:
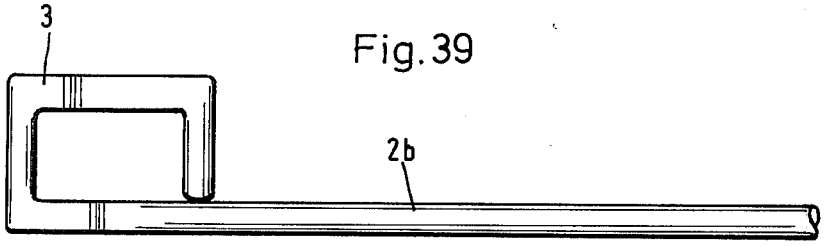
FIG. 39 is an elevation of a portion of a ski binding component.
Figure 40:
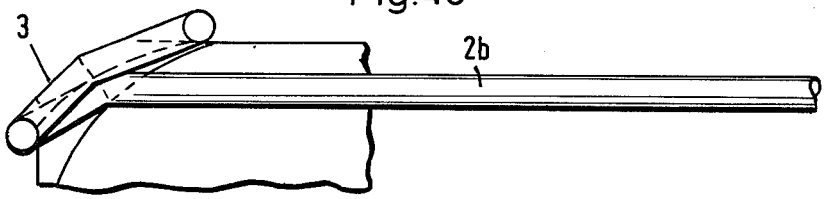
FIG. 40 is a plan of such component.

FIGS. 39 and 40 show toe clips of special formation. The clip is in the form of a rod loop which exerts a firm grip on the shoe sole but which will be disengaged from the shoe sole quickly by rotation of the swivel rod 2*b*.

The ski bindings of FIGS. 41 to 44 show leaf springs for centering the boot support relative to the ski. Both in the form of FIGS. 41 and 42 and in the form of FIGS. 43 and 44, the boot support carries both toe binding and heel binding of at least one of the types discussed above. The block 5*b* of the boot support has in it an arcuate slot receiving pin 97 projecting upward from the ski into the slot. Such slot guides swinging of the boot holder relative to the ski about the axis of pivot 51. The pack of spring leaves 82 which center the boot holder relative to the ski have their opposite ends secured in clevis holders on the block 5*b* and the stationary stem 5*c* by transverse pins or rivets 99. The stem 5*c* is movable longitudinally of the ski so that the functioning of the ski boot releasing mechanism is assured even if the ski bends, as indicated by the broken lines in FIG. 41, which might be caused by the ski traveling over uneven ground.

Figure 43:
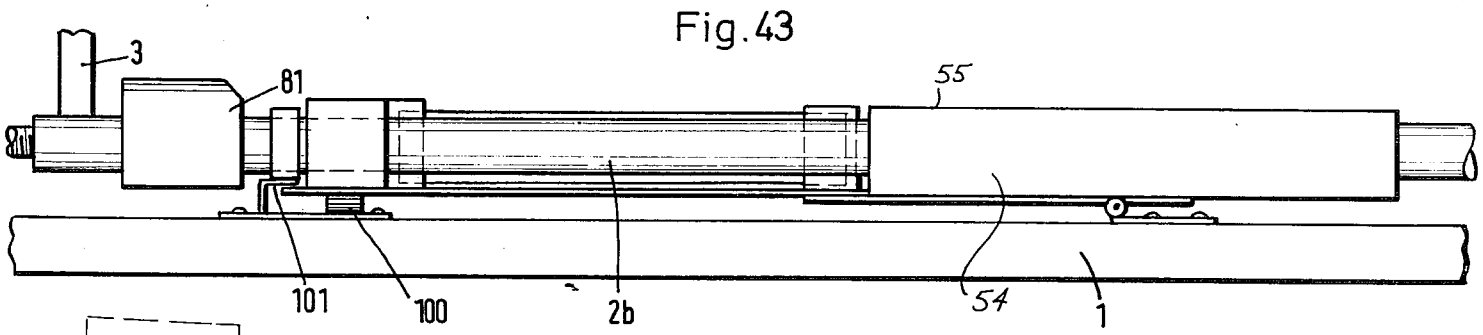
FIG. 43 is a side elevation of still another type of ski binding according to the present invention with parts broken away.
Figure 44:
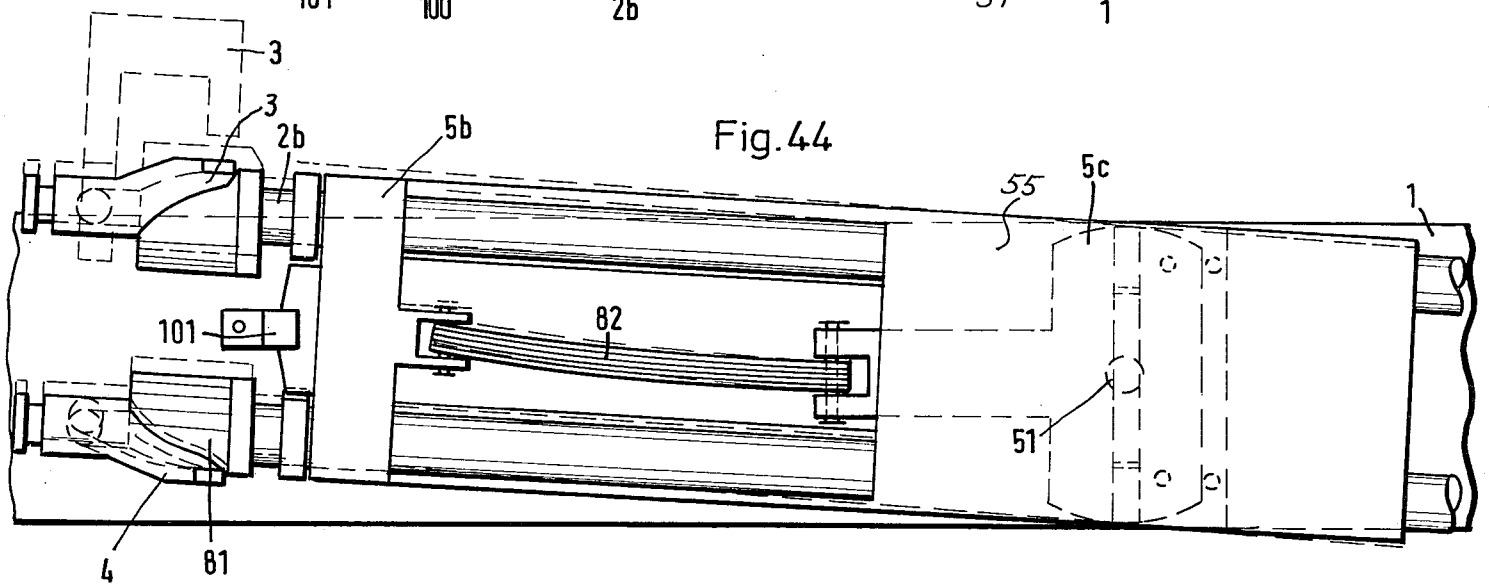
FIG. 44 is a plan of such binding having parts shown in section.

In FIGS. 43 and 44, the centering leaf spring 82 is shown in bent condition exerting a force on the boot holder to return it into alignment with the ski. In this structure, the slotted guide is omitted and reliance simply placed on the spring 82 to center the boot holder, but centering is facilitated by the boot holder being supported on the ski by an antifriction strip 100. The boot holder is held down by an angle member 101 overlying a flange of the boot holder.

Figure 45:
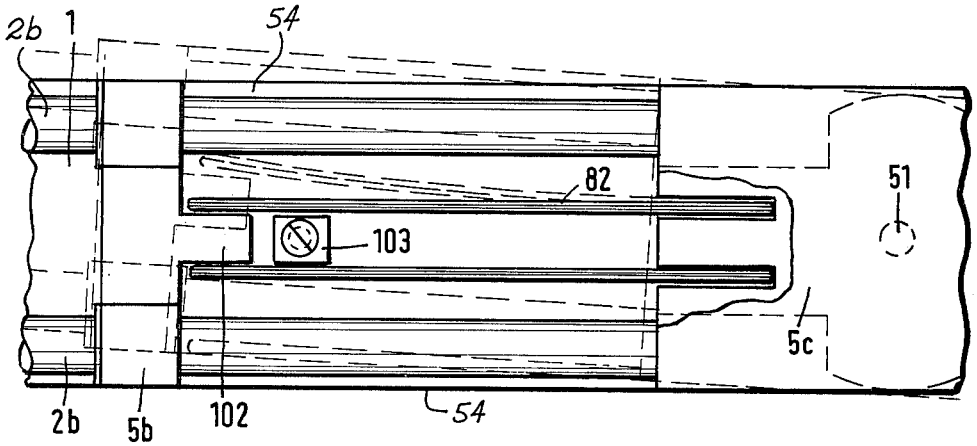
FIG. 45 is a plan of a portion of a different ski binding according to the present invention with parts shown in section.

FIGS. 45 to 49, inclusive, show modified types of centering leaf spring arrangements. In FIG. 45 the leaf spring is prestressed.

Figure 46:
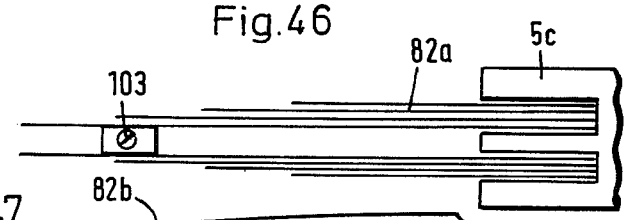
FIGS. 46 and 47 are plans of alternative types of components for the ski binding shown in FIG. 45.
Figure 47:
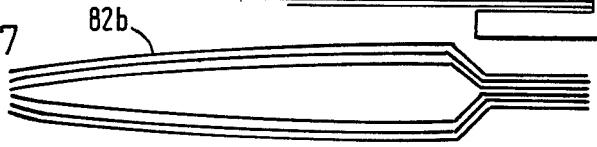

In the leaf spring arrangement of FIG. 46, the leaves 82*a* are of different lengths.

In the leaf spring arrangement of FIG. 47, the leaves again are shown as being prestressed.

Figure 48:
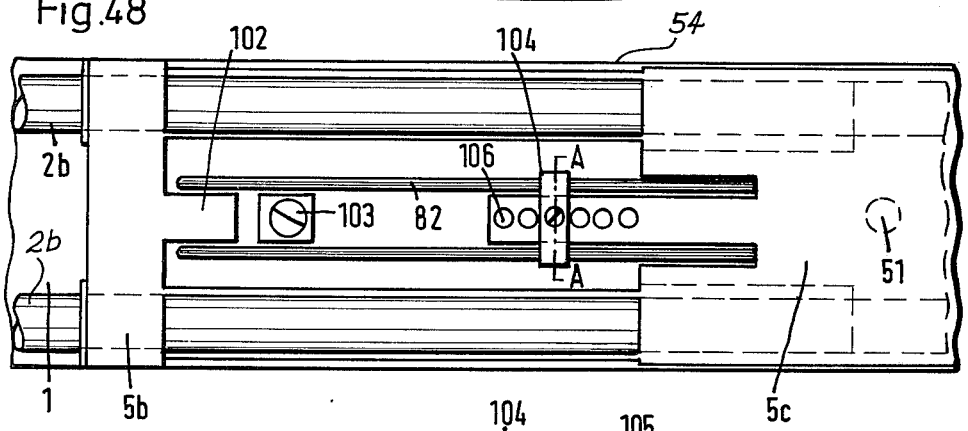
FIG. 48 is a plan of the same general type of ski binding shown in FIG. 45, but having a somewhat modified construction.
Figure 49:
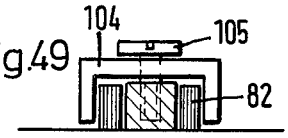
FIG. 49 is a detail vertical section through a component of the ski binding shown in FIG. 48 taken on line A—A of that figure.

In the centering spring structure of FIGS. 48 and 49, the degree of spring force can be adjusted by shifting the spring-holding clamp forward or rearward to alter the active length of the leaf springs.

Figure 50:
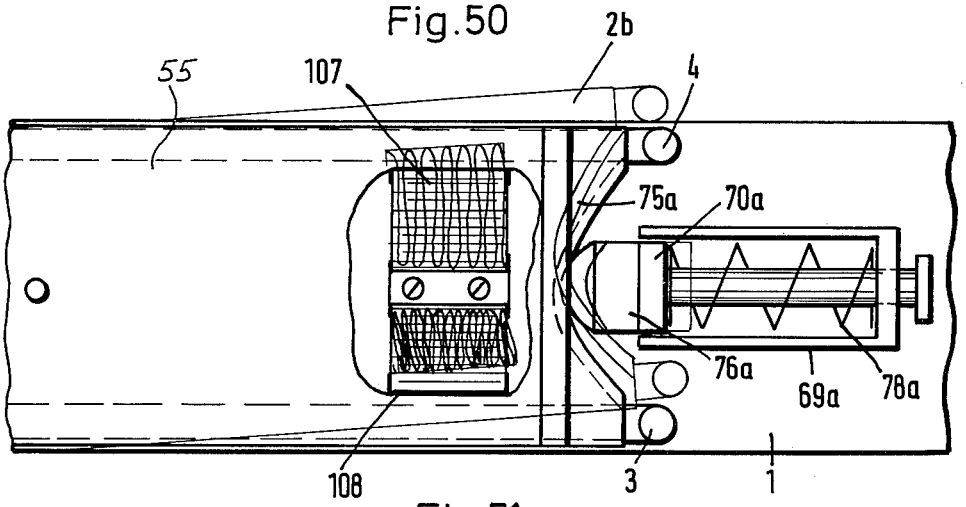
FIG. 50 is a plan of a portion of another type of ski binding according to the present invention having parts broken away.
Figure 51:
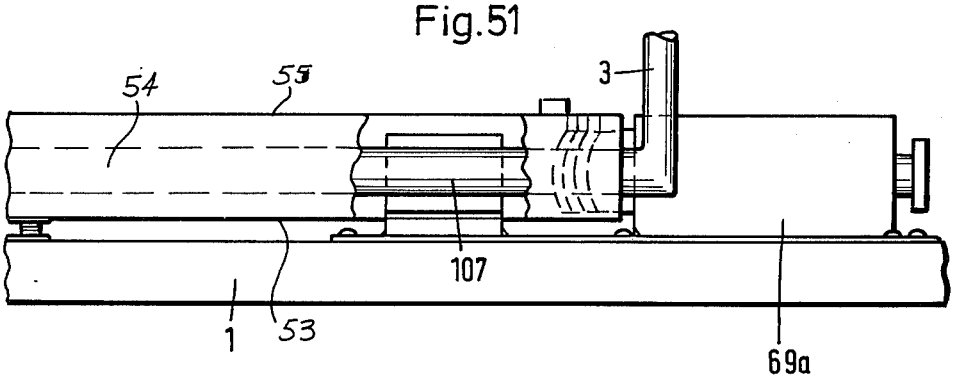
FIG. 51 is a side elevation of the portion of the ski binding shown in FIG. 50 with parts broken away.

In the ski binding of FIGS. 50 and 51, an elastic element 107 mounted in a holder 108 is substituted for the centering leaf springs. The ski binding also has a centering plunger 70*a* received in a cylinder 69*a* and pressed outward by a compression spring 78*a*. The head 76*a* of the plunger cooperates with a concavely curved track 75*a* to assist in centering the boot support on the ski. In this instance, as in the device of FIG. 25, movement of the piston 70*a* in the cylinder 69*a* serves to dampen swinging of the foot support relative to the ski. In this instance, the dampening arrangement is located in front of the boot support.

Figure 52:
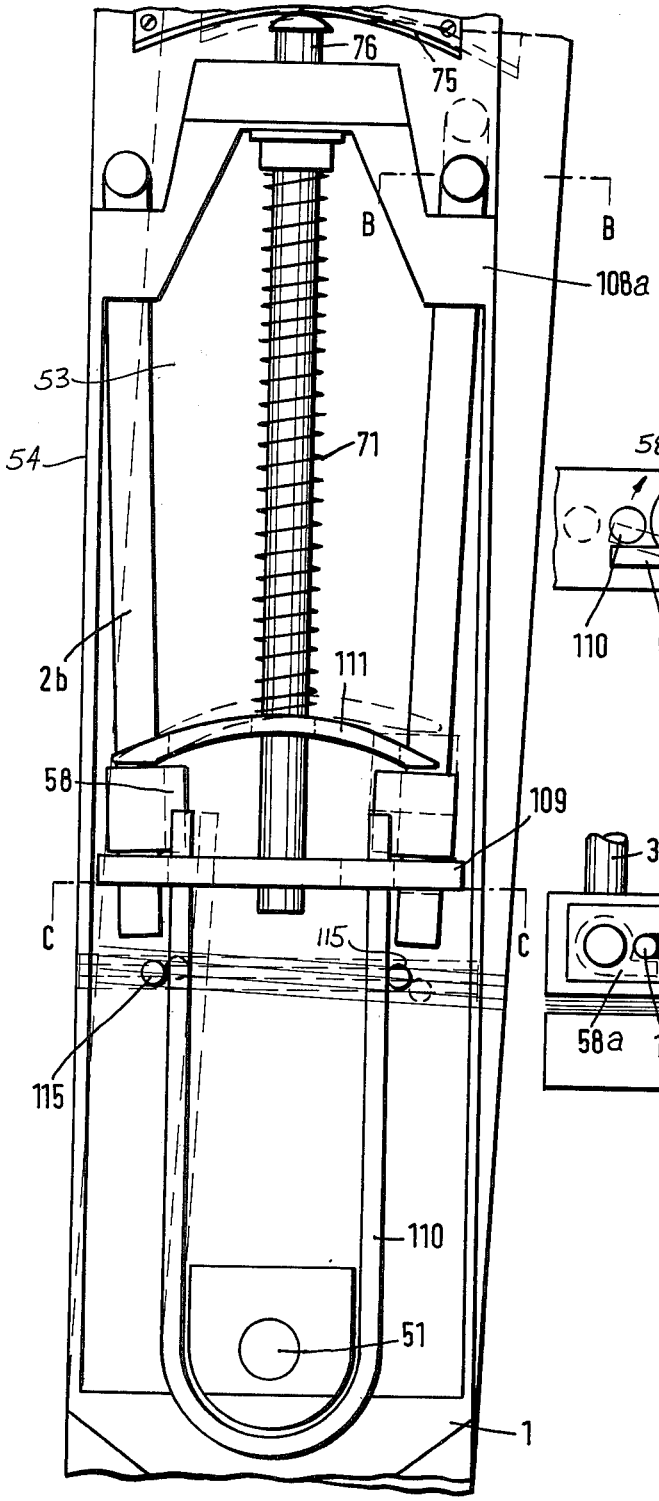
FIG. 52 is a plan of still a different type of ski binding according to the present invention having parts broken away and other parts shown in section.
Figure 53:
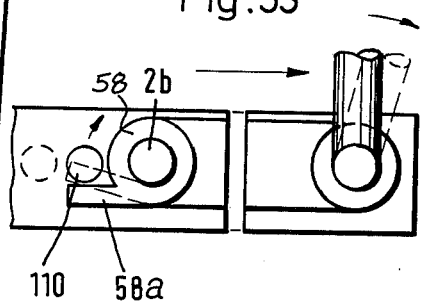
FIG. 53 is a fragmentary vertical section through a component of the ski binding shown in FIG. 52 taken on line B—B of that figure and having parts broken away.
Figure 54:
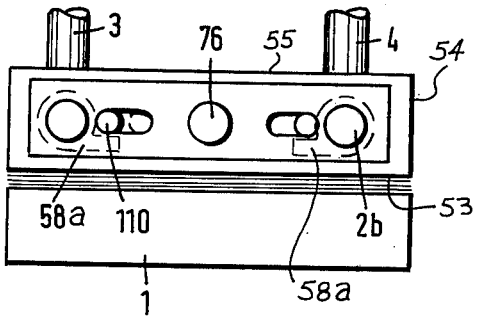
FIG. 54 is a vertical transverse section through the ski binding of FIG. 52 taken on line C—C of FIG. 52.

In the ski binding shown in FIGS. 52 to 54, inclusive, the swivel rods 2*b* are mounted in fixedly spaced forwardly divergent relationship. The swivel rods are urged rearwardly by a bowed crossbar 11 engageable with blocks 58 on the swivel rods, which crossbar is pressed rearwardly by a compression spring 71. The forward end of such spring engages a yoke 108*a* connecting guide sleeves for the swivel rods. The rearward ends of the swivel rods are connected by a spacer bar 109.

The blocks 58 are circular and have tangentially extending tongues 58*a* engageable with the forward ends of a U-shaped stop swingable about the pivot 51 with the boot holder. Opposite legs 110 of such stop are engageable with stop pins 115 carried by the base. Such legs of the U-shaped stop are flexible and are supported in cantilever fashion relative to the boot holder so that when the boot holder is subjected to excessive lateral force and one leg 110 of the stop member engages a stop pin 115, the boot holder can continue to swing relative to the ski around the axis of pivot 115 while movement of such leg of the stop member is arrested by the pin 115.

During normal use of the ski, the stop member will swing with the boot holder about the axis of pivot 51 and the forward ends of such stop member legs 110 will be engaged by the tongues 58*a* of the blocks 58, as shown at the left of FIG. 53 and in broken lines in FIG. 54. If the boot holder is swung relative to the ski about pivot 51 sufficiently to engage a leg 110 of the stop member with a stop pin 115, and such swinging then continues farther, the tongue 58*a* of a block 58 will be moved out of engagement with the arrested leg of the stop member so that it will be free to swing about the axis of its swivel rod, enabling such swivel rod to swivel for movement of the sole clip which it carries into boot-releasing position.

As shown in shaded lines at the right of FIG. 52, an excessively strong force exerted by the ski boot on a toe clip in a forward direction will slide the swivel rod forward, lengthwise of the ski, to move the tongue 58*a* of the block 58 carried by such swivel rod beyond the forward end of the corresponding stop member leg 110. In this way also, the tongue 58*a* will be freed for swiveling of the rod 2*b* to release the toe clip. Such forward movement of the swivel rod will be opposed by the compression spring 71 bearing on the crossbar 111, but the crossbar can swing to the shaded position shown in FIG. 52 to enable such movement to be accomplished.

Figure 55:
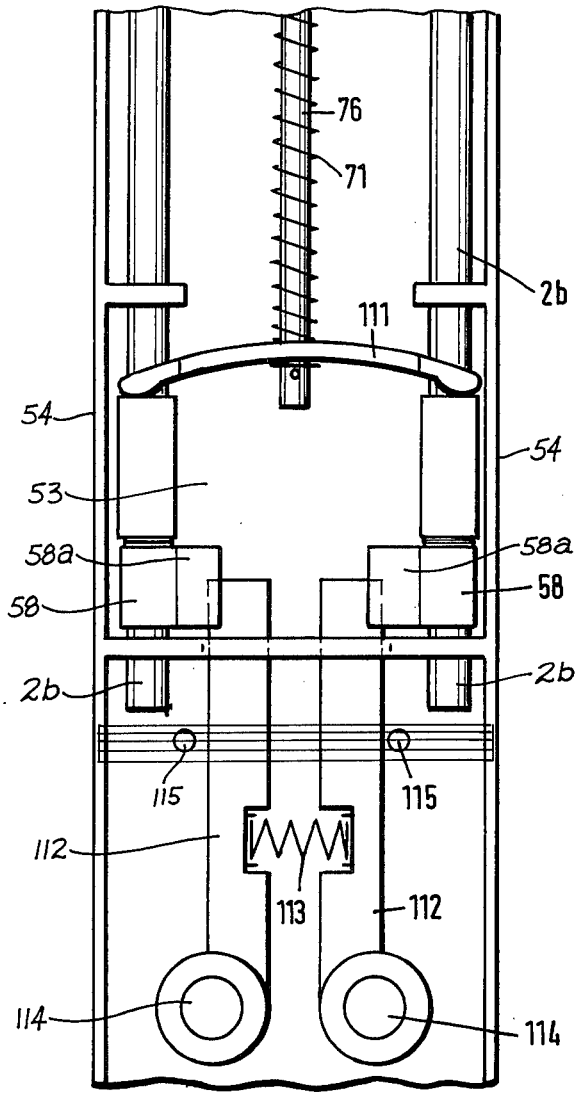
FIG. 55 is a plan of a ski binding similar to that shown in FIG. 52 but having a modified component, parts being shown in section.

In FIG. 55, the ski binding is the same as that shown in FIGS. 52 to 54, inclusive, except for the latch mechanisms for the tongues 58*a* of the blocks 58 mounted on the swivel rods 2*b*. Again, this mechanism is enclosed in a casing including bottom 53, sides 54 and a top which is not shown. In this construction, parallel arms 112 extending longitudinally of the ski are mounted in spaced relationship for swinging relative to the casing on pivots 114 mounting their rearward ends. Normally these arms are held apart by a compression spring 113 engaged between them.

The forward ends of the arms 112 are disposed in latching engagement with the tongues 58*a* of the blocks 58 during normal swinging of the casing relative to the ski about a pivot which is not shown. The base plate carries stop pins 115 engageable by the arms 112 when the casing swings relative to the ski beyond a predetermined angle. Such engagement of an arm with a stop pin will arrest further swinging of such arm relative to the ski while the casing can swing farther. Such farther swinging of the casing will move a tongue 58*a* out of position latched by the forward end of an arm 112 so that such tongue is free to rotate about the axis of the swivel rod 2*b* carrying block 58. Swiveling of such rod will enable the toe clip carried by it to rock into released position freeing the ski boot.

It will be evident from FIG. 55 that a tongue 58*a* can also be moved out of latching engagement with the forward end of an arm 112 by forward sliding of the swivel rod carrying the block 58 from which such tongue projects. Such reciprocation can be effected by application of an excessive forward force on the toe clip by a ski boot as discussed above.

The ski binding shown in FIG. 56 is generally the same as that of FIG. 55 but has minor modifications. In this instance, instead of the crossbar 111 being urged rearwardly by a helical compression spring 71, elastomer spools are slidable on the rod 76. A series of such elastomer spools is engaged between the casing end 54*a* and the crossbar 111. This force-exerting arrangement is more compact than the arrangement of FIG. 55.

Also for the purpose of making a more compact structure, the stop arms 112*a* swingable relative to the boot support about pivots 114*a* are much shorter than the stop arms 112 shown in FIG. 55. The spring 113*a* spreading the stop arms 112*a* apart is engaged between their end portions. Moreover, the end portions of such stop arms are flared so that they can be engaged more readily with the tongues 58*a* of the blocks 58. The mechanism shown in this figure operates in the same manner as described in connection with the construction of FIG. 55, so it need not be repeated.

The ski binding shown in FIGS. 57 and 58 is similar to that described in connection with FIG. 56 except that the elastomer force-producing means 71*b* is replaced by a compression spring 71. This compression spring arrangement differs from that shown in FIGS. 52 to 55 by being of sufficiently large diameter and sufficiently short so that a guide rod 76 extending through it is not necessary. Consequently, the construction shown in FIG. 57 in which the compression spring is engaged between the casing end 54*a* and the crossbar 111 has the compactness comparable to that of the construction shown in FIG. 56.

FIG. 59 shows somewhat diagramatically a portion of the structure of the ski binding shown in FIGS. 57 and 58. If an excessive force in the direction I is exerted by the ski boot on the toe clip 3, the right swivel rod 2*b* will be slid forward relative to the guide sleeve 5 to withdraw the tongue 58*a* of the block 58 from engagement with a latch member. The toe clip 3 can then rock outward to release the ski boot. The application of such excessive forward force on the toe clip 3 may be transmitted through its swivel rod 2*b* and the crossbar 111 to the left swivel rod 2*b* so as to move that swivel rod forward also. If the left swivel rod is moved forward far enough by this operation, the tongue 58*a* of the left block 58 also will be freed so that the left toe clip 4 can rock into released position completely free of the ski boot. Usually, however, at least some force will be exerted forwardly as indicated by III on the left toe clip 4, as well.

FIGS. 60 to 64, inclusive, also show compact types of ski binding arrangement. The construction of the mechanism shown in FIG. 60 is similar to that of FIGS. 56 to 59, except that in this instance the swivel rods 2*b* are guided for longitudinal movement simply by passing through apertures in the front wall 54*a* of the casing 53, 54, and a cross wall 54*b* in the casing. The rearward force is exerted on the swivel rods by individual compression springs encircling such rods, respectively, and having their forward ends engaged with the front end of the casing 54*a* and their rearward ends bearing on collars 58*b* secured to the swivel rods. The latching arrangement for the tongues 58*a* of the blocks 58 is the same as described in connection with FIG. 56.

In the modification of FIG. 61, the resilient rearward force is exerted on the swivel rods 2*b* by two compression springs 121 acting on a scissors linkage. Such linkage includes two links 118 and 119 connected in crossed arrangement by a pivot 120. One end of link 118 is secured by a pin 118*a* received in a slot of the link and carried by the bottom 53 of the casing. One end of the other link 119 is attached by a pin 119*a* received in a slot of the arm and mounted on the casing bottom 53. The opposite ends of the links are pivotally connected to the collars 58*b* on the swivel rods 2*b*.

The pivot 120 connecting the links 118 and 119 also extends through a spring mount 122. The linkage 118, 119 serves as a pantograph so that the collars 58*b* and swivel rods 2*b* move lengthwise of the casing a distance approximately twice as great as the longitudinal movement of the spring mount 122. The remainder of the ski binding mechanism shown in FIG. 61 is similar to that of FIG. 56 and the operation is the same.

FIG. 62 shows a somewhat modified type of spring arrangement used with scissors linkage. In this instance, the links 118 and 119 are not interconnected by a pivot, but instead the spring mount 122*a* carries a pin 120*a* that simply bears on a crotch formed by the crossing links. Also, in this instance the spring force is exerted by a leaf spring 121*a* instead of by a pair of compression springs.

In FIGS. 63 and 64, the spring arrangement is double-acting. The spring mount 122*b* has not only the pin 120*a* engaging the crotch of the linkage near the front of the casing, but also has a pin 120*b* engageable with the crotch of the linkage farther rearward. To maintain alignment of the spring mount, a slot 120*c* in it engages a pin 120*d* mounted on the casing bottom 53.

The spring pressure mechanisms shown in FIG. 62 and in FIGS. 63 and 64 can be substituted for the spring arrangement shown in FIG. 61. The ski bindings incorporating such spring mechanisms all operate in the same general manner, as described in connection with FIGS. 56 and 59.

Figure 65:
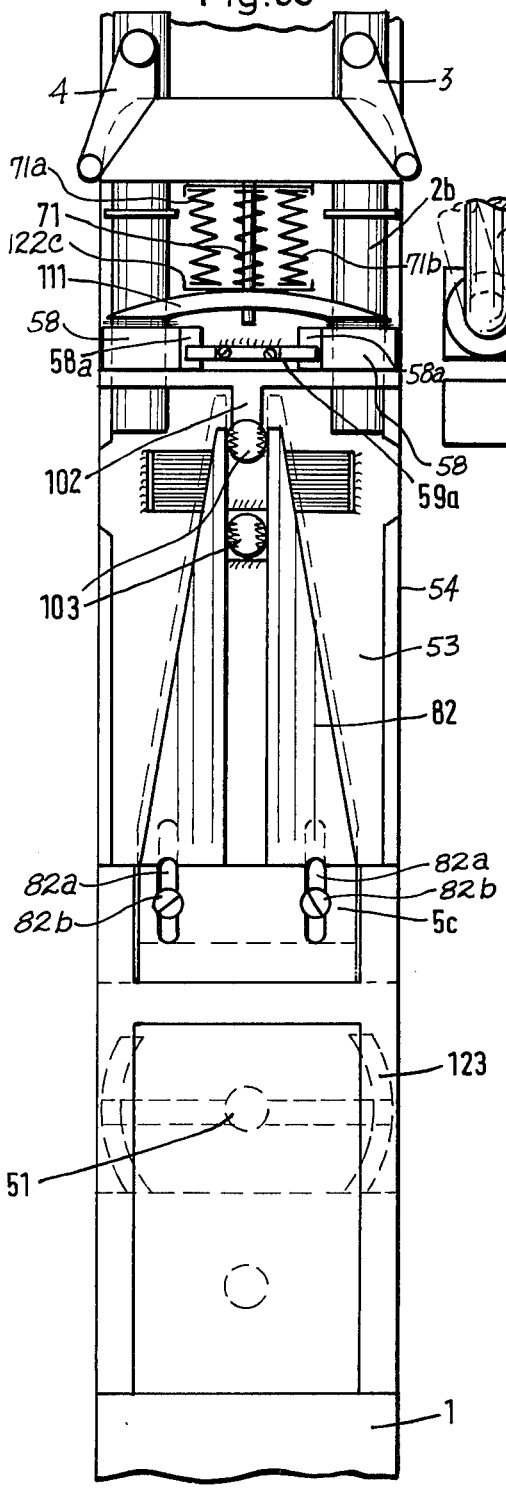
FIG. 65 is a plan of still a further modified ski binding according to the present invention.

The spring pressure mechanism of the ski binding shown in FIG. 65 is similar to that of FIG. 55, except that two additional compression springs 71*a* and 71*b* are located at opposite sides of the spring 71. The spring mount 122*c* bears on the center of a crossbar 111, the opposite ends of which are engaged with blocks 58 as shown in FIG. 52.

Figure 67:
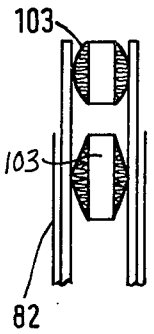
FIG. 67 is a plan of a portion of a component of the ski binding shown in FIG. 65 having a somewhat modified construction. DETAILED DESCRIPTION As shown in the drawings, the objects of this invention can be accomlished by a considerable variety of different types of ski bindings, but all of such ski bindings have certain common characteristics. All of the ski bindings have two clips for engagement with the toe portion of a ski boot sole edge which clips are mounted for swiveling about axes that extend longitudinally of the ski between positions securing the toe of a ski boot to the ski and an outwardly swiveled relesed position in which the ski boot is free to separate from the ski. The sole clips execute such boot releasing movement automatically if they are subjected to a predetermined overstress by the ski boot tending to move relative to the ski.

Again, the casing housing the mechanism of the ski binding can swing relative to the ski about pivot 51. Arcuate antifriction strips 123 can be located between the casing and the base plate to facilitate swinging of the casing relative to the ski. The casing is resiliently centered relative to the ski by a leaf spring arrangement 82 of one of the types shown in FIGS. 45 to 49, inclusive. Buttons 103 of elastomer material are interposed between the springs leaves as shown in FIG. 65 and FIG. 67. The longitudinal position of the leaf spring arrangement can be adjusted by sliding their slots 82*a* relative to anchoring screws 82*b*.

Figure 66:
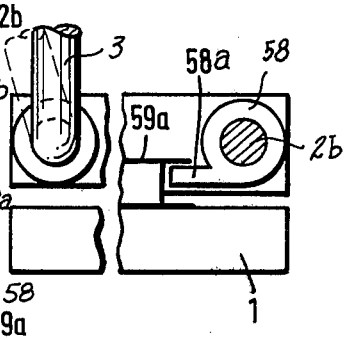
FIG. 66 is a detail vertical section of a component of the ski binding shown in FIG. 65 with parts broken away.

Swiveling of the toe clips into released position again is prevented under normal use of the ski by latch mechanism 59*a* engageable with the tongues 58*a* of blocks 58 carried by the swivel rods 2*b*, as shown in FIG. 66.

I claim:

1. In a ski binding including a toe clip and swivel means mounting the clip for swiveling about an axis extending longitudinally of a ski, the improvement comprising guide means guiding the swivel means for movement lengthwise of the ski between a rearward position in which the toe clip is engaged with a ski boot sole in retaining relationship and a forward position in which the toe clip is swivelable into sole-released position, mounting means supporting said guide means for movement transversely of the ski, and resilient force-producing means for exerting a force on the swivel means normally retaining them in their rearward position.

2. In the ski binding defined in claim 1, two toe clips, and cross-connecting means extending transversely of the ski, interconnecting the two toe clips and transmitting force from the force-producing means to the toe clips.

3. In the ski binding defined in claim 2, the cross-connecting means including a crossbar connecting the two toe clips.

4. In the ski binding defined in claim 2, the cross-connecting means including scissors linkage.

5. In the ski binding defined in claim 1, the resilient force-producing means including a tension spring.

6. In the ski binding defined in claim 1, the force-producing means including a compression spring.

7. In the ski binding defined in claim 1, the force-producing means including a leaf spring.

8. In the ski binding defined in claim 1, the toe clip including a cylindrical rod, and the guide means including a guide sleeve encircling said cylindrical rod.

9. In the ski binding defined in claim 8, pivot means supporting the guide sleeve for swinging about an upright axis, and transverse force resilient means urging corresponding ends of the guide sleeves to move away from each other.

10. In the ski binding defined in claim 9, the transverse force resilient means including a tension spring extending transversely of the ski and connecting the guide sleeves, and means for connecting said tension spring to the guide sleeves at different locations along their lengths.

11. In the ski binding defined in claim 1, torsion spring means exerting a torsion force on the swivel means.

12. In the ski binding defined in claim 1, holding means engageable between the swivel means and the guide means preventing swiveling of the swivel means relative to the guide means when the swivel means and the guide means are in one position lengthwise of the ski, and said holding means being rendered inoperable to prevent swiveling of the swivel means by predetermined relative movement of the swivel means and the guide means longitudinally of the ski.

13. In the ski binding defined in claim 12, the holding means including the guide means having a notch for receiving a portion of the swivel means, and said notch having an inclined side for wedging engagement with such portion of the swivel means to effect relative movement of the swivel means and the guide means lengthwise of the ski.

14. In the ski binding defined in claim 12, the holding means including a roller carried by the swivel means, and the guide means having a notch for receiving the roller.

15. In the ski binding defined in claim 1, wedging means engageable with a portion of the swivel means for wedging the swivel means longitudinally of the ski relative to the guide means.

16. In the ski binding defined in claim 1, a footplate for supporting a ski boot and overlying the guide means, the mounting means and the resilient force-producing means.

17. In the ski binding defined in claim 16, a heel binding component above the footplate, a longitudinal bar located below the footplate, means mounting said longitudinal bar for lengthwise reciprocation, and heel binding component release means operable by rearward reciprocation of said longitudinal bar to release said heel binding component.

18. In the ski binding defined in claim 17, the resilient force-producing means being connected to the longitudinal bar for urging such bar forward.

19. In the ski binding defined in claim 17, the longitudinal bar being alterable in effective length.

20. In the ski binding defined in claim 17, the longitudinal bar including a forward section and a rearward section, and resilient connecting means connecting together said forward section and said rearward section.

21. In the ski binding defined in claim 16, pivot means mounting the footplate for swinging relative to the ski about an axis extending substantially perpendicular to the ski, and means for releasing the swivel means for movement of the toe clip into sole-released position when the floorplate is swung relative to the ski beyond a predetermined degree.

22. In the ski binding defined in claim 21, latch-engaging means carried by the swivel means, and latch means engageable with the latch-engaging means to prevent swiveling of the swivel means during swinging of the footplate relative to the ski through a predetermined angle.

23. In the ski binding defined in claim 22, the latch means including an angle recess, and the latch-engaging means including a member receivable in such recess for preventing swiveling of the swivel means while said member is in one leg of such angle recess, and the swivel means being released by movement of said member into the other leg of said angle recess.

24. In the ski binding defined in claim 22, the latch means being spring pressed.

25. In the ski binding defined in claim 21, transverse force-producing means for detering swinging movment of the footplate relative to the ski.

26. In the ski binding defined in claim 16, means guiding the footplate for swinging relative to the ski, and centering means for centering the footplate relative to the ski including a concave track carried by the ski and a follower spring pressed against the track in a direction longitudinally of the ski.

27. In the ski binding defined in claim 26, damping means for damping swinging movement of the footplate relative to the ski.

28. In the ski binding defined in claim 1, adjusting means for the resilient force-producing means for altering the degree of force exerted on the swivel means which normally retains the swivel means in their rearward position.

29. In the ski binding defined in claim 1, boot-supporting means overlying the swivel means, and means for lowering the boot-supporting means conjointly with swiveling of the swivel means for movement of the toe clip into sole-released position.

30. In the ski binding defined in claim 29, the sole-supporting means including an eccentric member mounted on the swivel means.

31. In the ski binding defined in claim 1, means mounting the swivel means for movement laterally of the ski, a first member projecting upward from the margin of the ski, and a second member projecting downward from the swivel means in alignment with said first member longitudinally of the ski, overlapping said first member horizontally and located adjacent to said first member for engagement therewith by movement of the swivel means transversely of the ski, such engagement effecting swiveling of the swivel means to move the toe clip into sole-released position.

* * * * *